US006717551B1

(12) United States Patent
Desclos et al.

(10) Patent No.: US 6,717,551 B1
(45) Date of Patent: Apr. 6, 2004

(54) LOW-PROFILE, MULTI-FREQUENCY, MULTI-BAND, MAGNETIC DIPOLE ANTENNA

(75) Inventors: Laurent Desclos, San Diego, CA (US); Jeff Shamblin, San Marcos, CA (US); Gregory Poilasne, San Diego, CA (US); Vaneet Pathak, San Diego, CA (US); Sebastian Rowson, San Diego, CA (US)

(73) Assignee: Ethertronics, Inc., San Diego, CA (US)

( * ) Notice: Subject to any disclaimer, the term of this patent is extended or adjusted under 35 U.S.C. 154(b) by 0 days.

(21) Appl. No.: 10/293,465

(22) Filed: Nov. 12, 2002

(51) Int. Cl.[7] ..... H01Q 1/38

(52) U.S. Cl. ..... 343/700 MS; 343/803; 343/806

(58) Field of Search ..... 343/700 MS, 846, 343/848, 806, 803, 810, 742, 867, 702; H01Q 1/38

(56) References Cited

U.S. PATENT DOCUMENTS

| | | | | |
|---|---|---|---|---|
| 3,721,990 A | | 3/1973 | Gibson et al. | |
| 4,684,952 A | | 8/1987 | Munson et al. | |
| 5,450,090 A | | 9/1995 | Gels et al. | |
| 5,627,550 A | | 5/1997 | Sanad | |
| 5,781,158 A | | 7/1998 | Ko et al. | |
| 5,943,020 A | | 8/1999 | Liebendoerfer et al. | |
| 6,008,762 A | | 12/1999 | Nghiem | |
| 6,114,996 A | | 9/2000 | Nghiem | |
| 6,133,880 A | | 10/2000 | Grangeat et al. | |
| 6,195,051 B1 | | 2/2001 | McCoy et al. | |
| 6,304,222 B1 | | 10/2001 | Smith et al. | |
| 6,323,810 B1 | | 11/2001 | Poilasne et al. | |
| 6,329,955 B1 | * | 12/2001 | McLean et al. | 343/742 |
| 6,348,894 B1 | | 2/2002 | Lahti | |
| 6,456,243 B1 | * | 9/2002 | Poilasne et al. | 343/700 MS |
| 6,486,848 B1 | * | 11/2002 | Poilasne et al. | 343/797 |

FOREIGN PATENT DOCUMENTS

| | | |
|---|---|---|
| EP | 0 604 338 | 3/1998 |
| EP | 0 942 488 | 9/1999 |
| EP | 1 067 627 | 1/2001 |
| JP | 56 012102 | 2/1981 |
| JP | 9 055621 | 2/1997 |
| JP | 2000 031735 | 1/2000 |
| JP | 2000 068736 | 3/2000 |

OTHER PUBLICATIONS

International Search Report from PCT Application No. PCT/US 02/20242.

* cited by examiner

*Primary Examiner*—Hoanganh Le
(74) *Attorney, Agent, or Firm*—Foley & Lardner

(57) ABSTRACT

Multi-frequency, low-profile, capacitively loaded magnetic dipole antennas to be used in wireless communications. Each antenna comprises one to n antenna elements and each element having one to n arms. The various antenna embodiments can cover a range of frequencies to be determined by the shape, size, and number of elements in the physical configuration of the antenna. The antenna configuration can also be adapted to expand frequency bands covered by the antenna or to fit within space restrictions dictated by specific antenna applications.

51 Claims, 22 Drawing Sheets

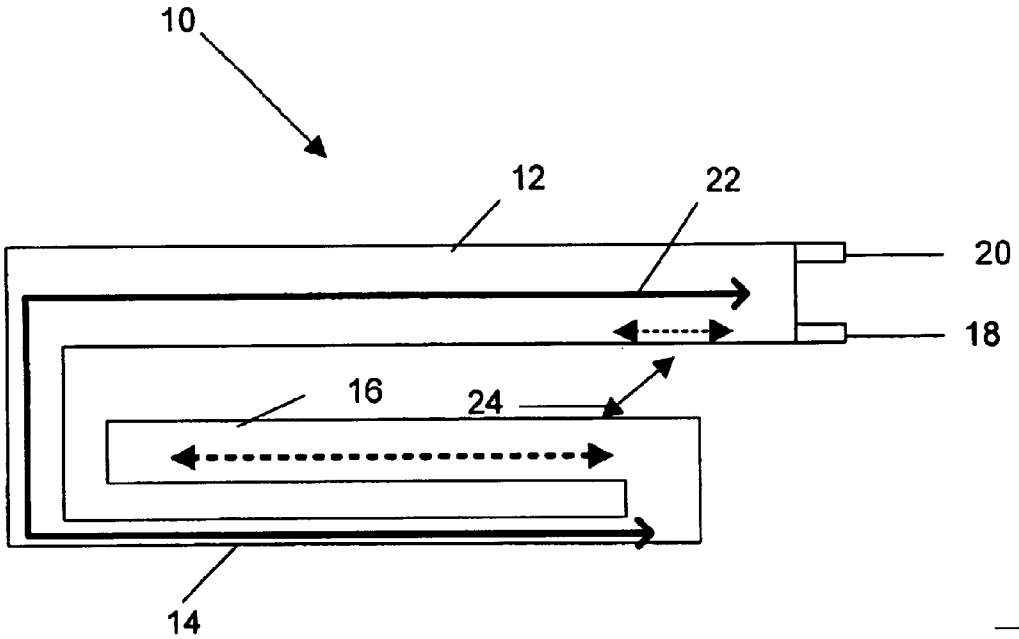
-Fig. 1a-
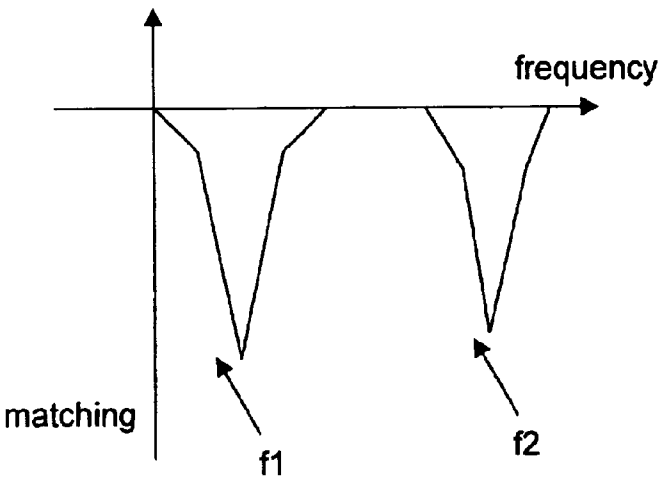
-Fig. 1b-

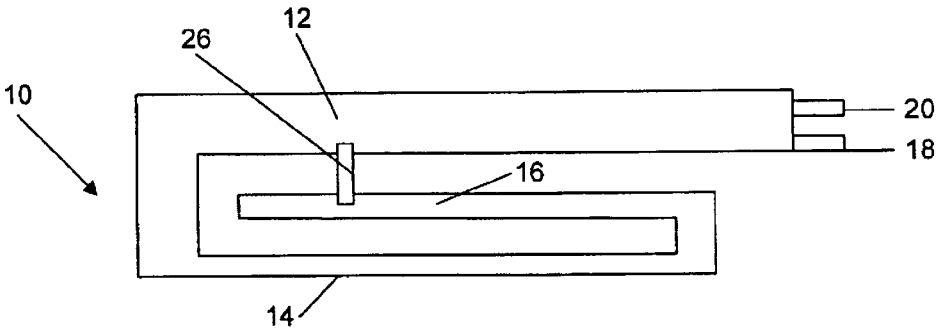
-Fig. 2a-
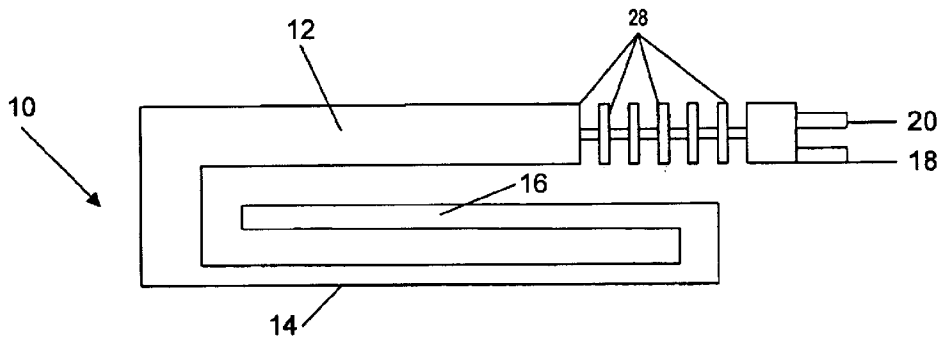
-Fig. 2b-
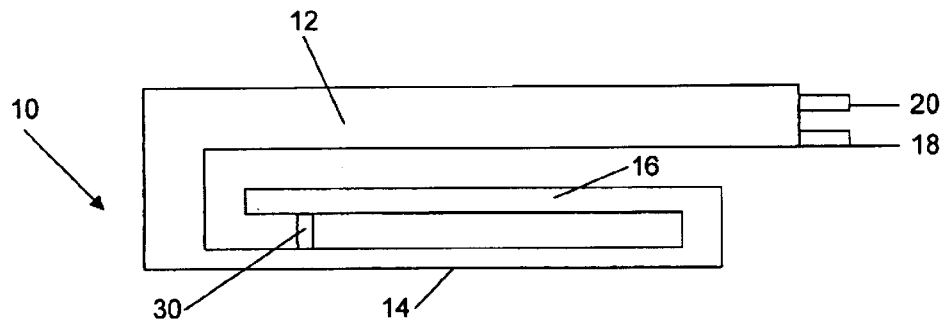
-Fig. 2c-

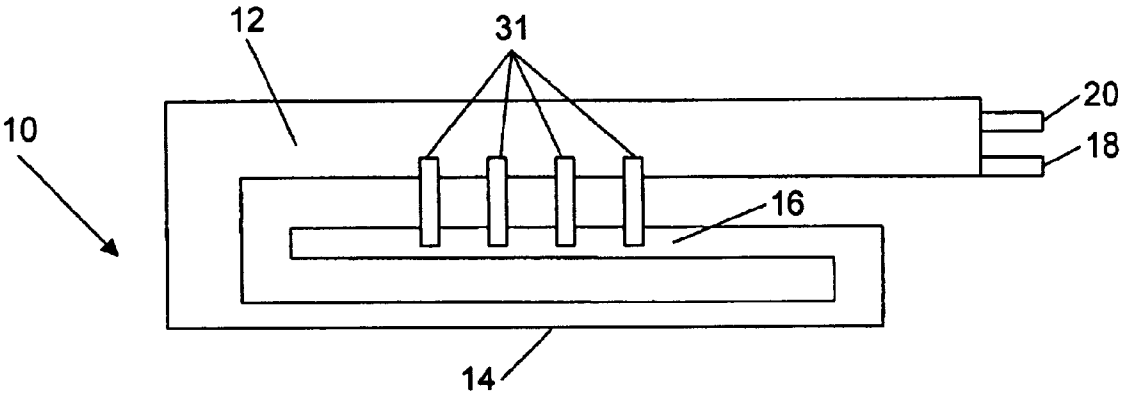
-Fig. 2d-
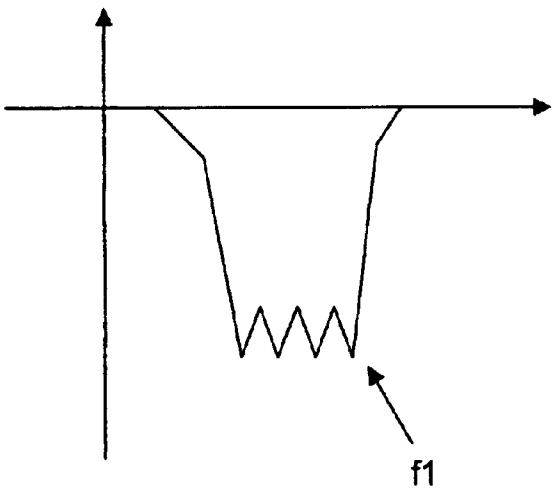
-Fig. 2e-

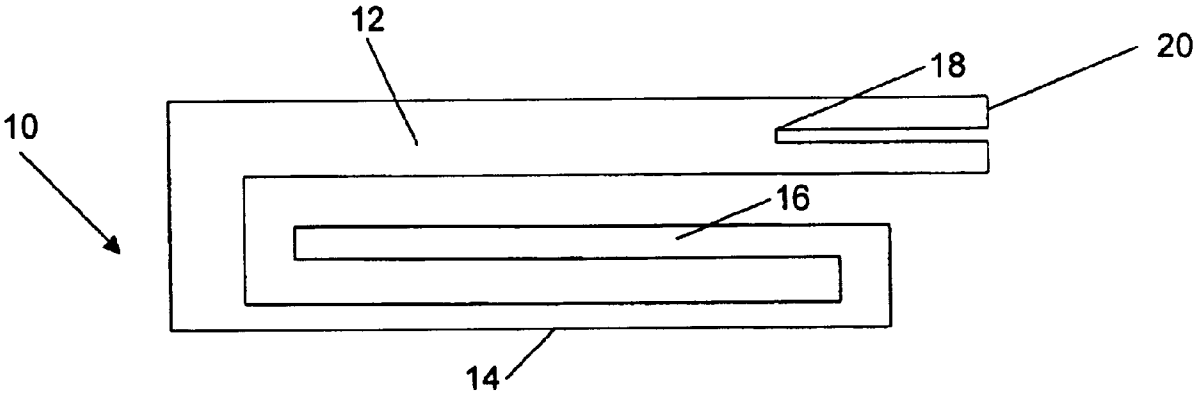
-Fig. 2f-
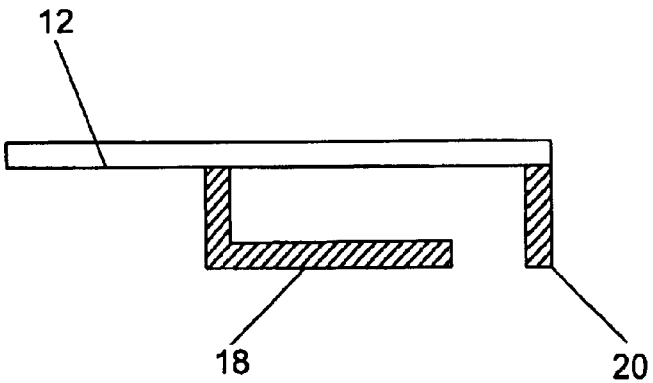
-Fig. 2g-

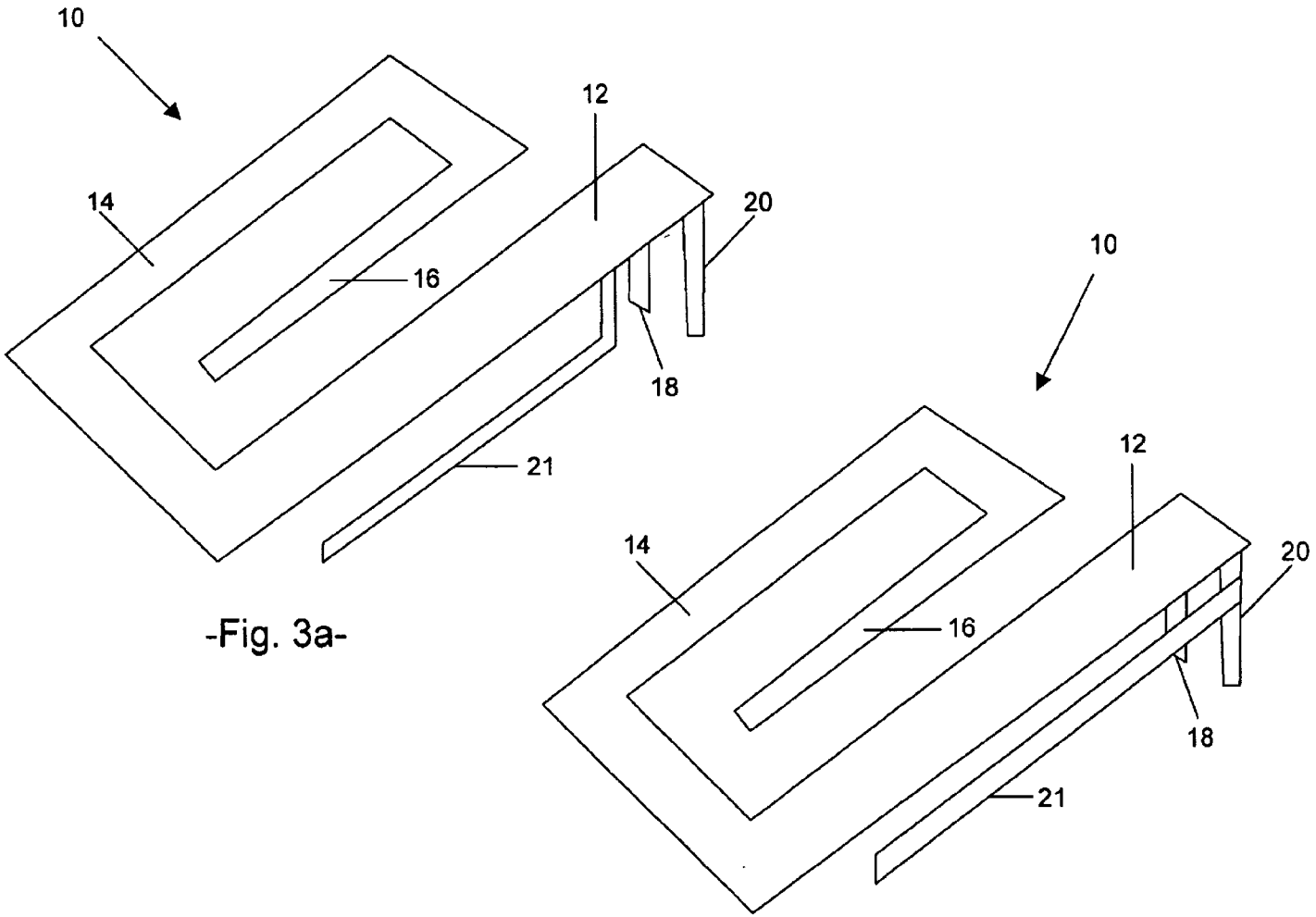
-Fig. 3a-
-Fig. 3b-

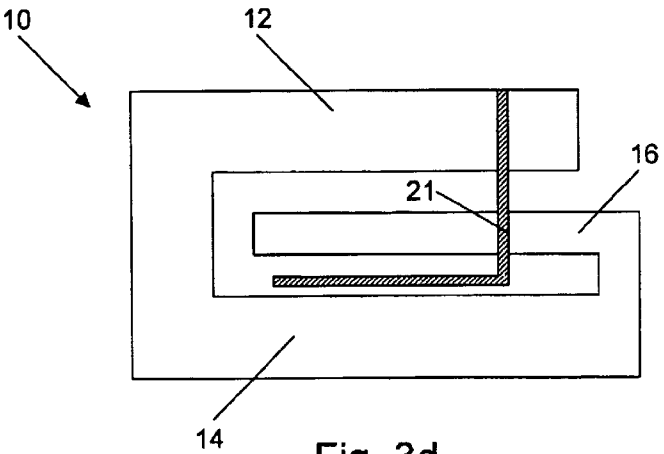
-Fig. 3d-
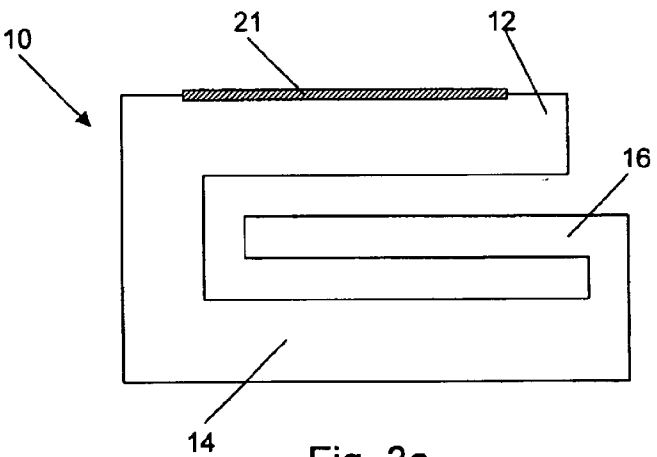
-Fig. 3c-
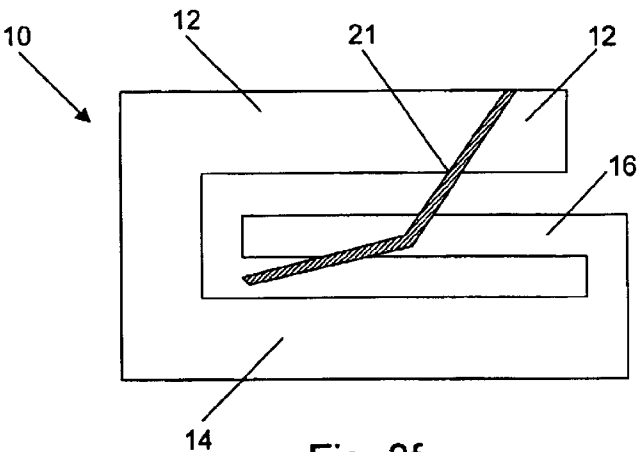
-Fig. 3f-
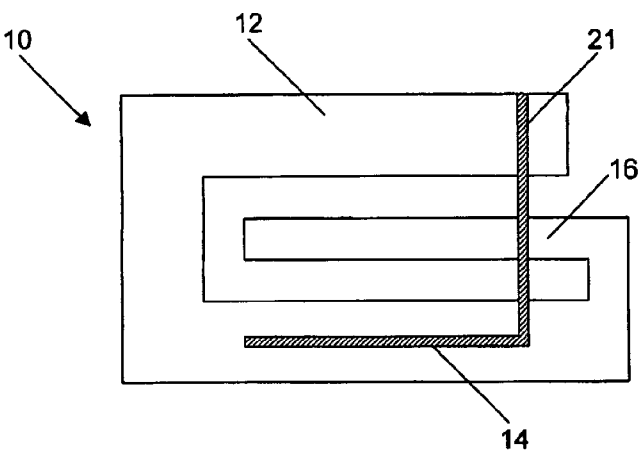
-Fig. 3e-

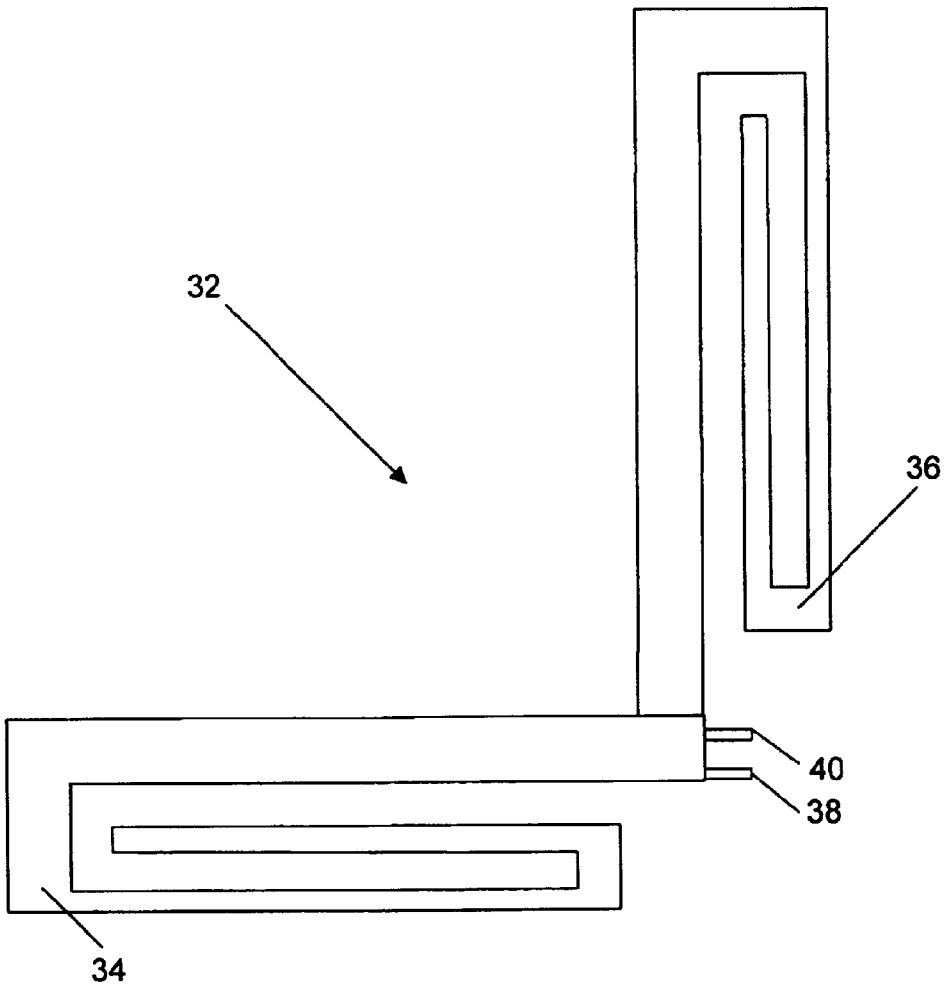
-Fig. 4-

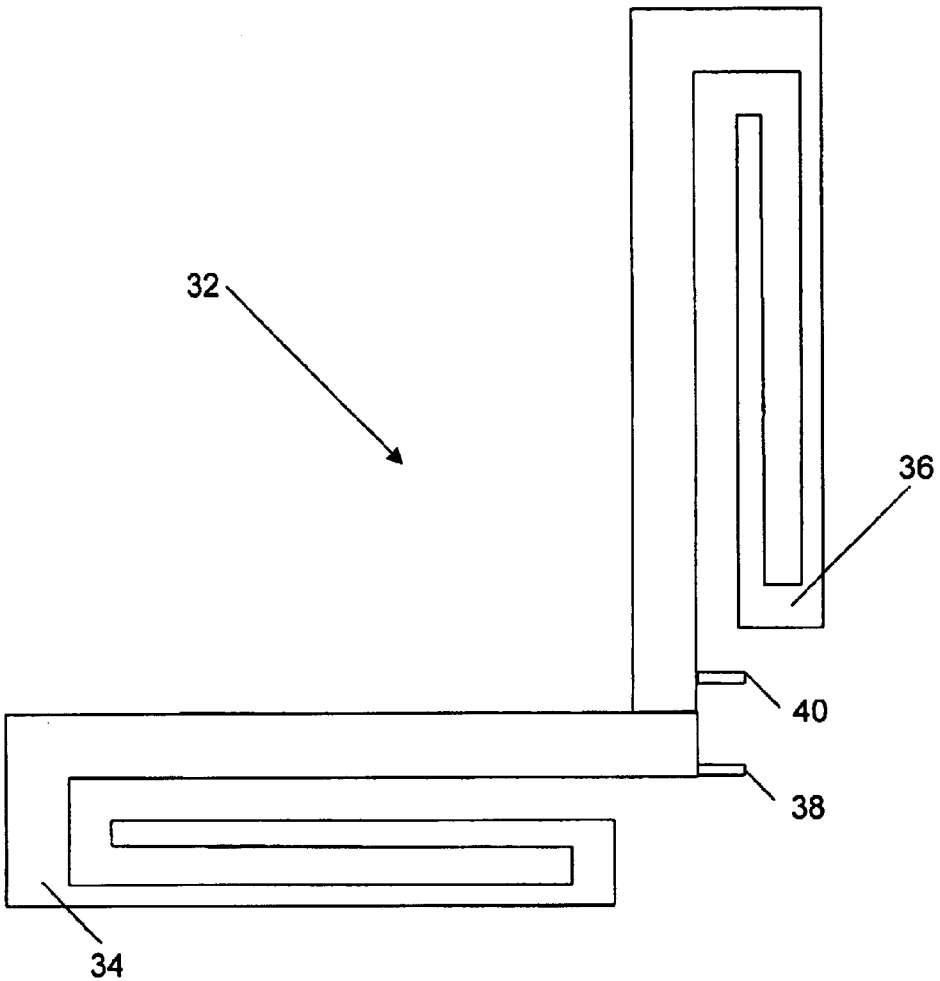
-Fig. 5-

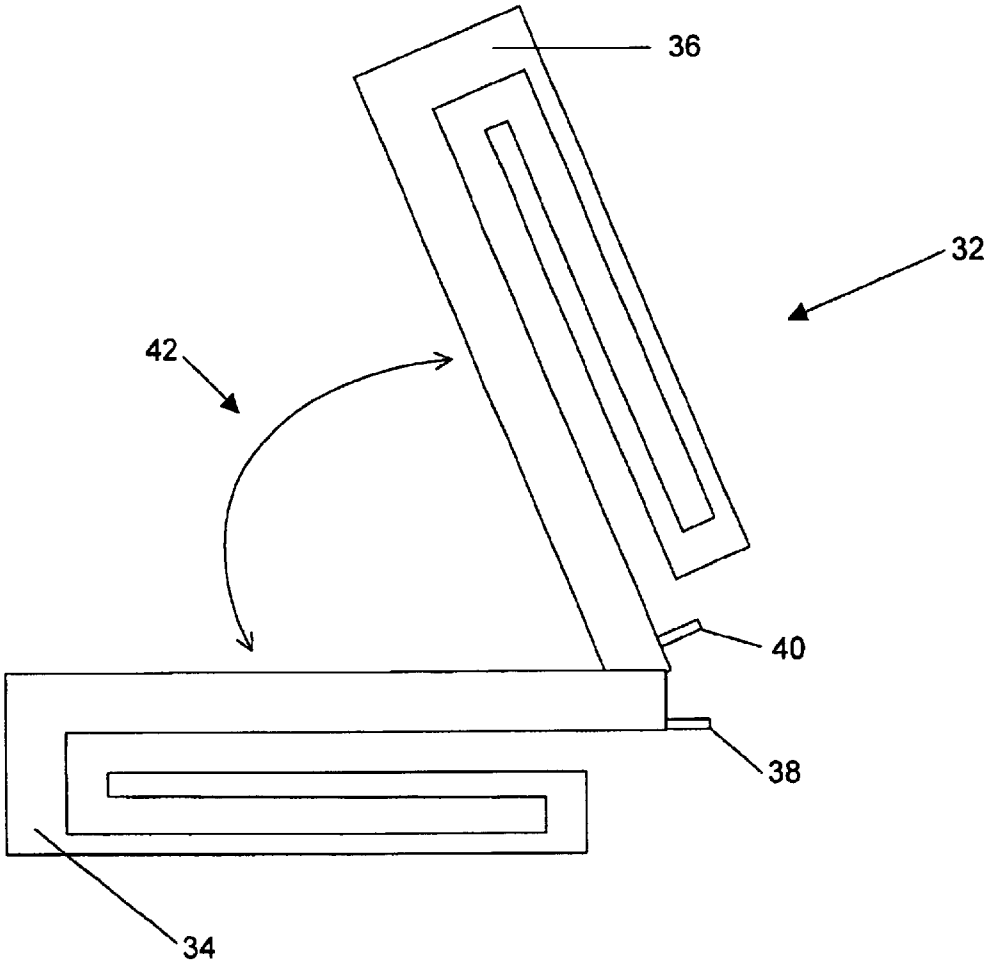
-Fig. 6-

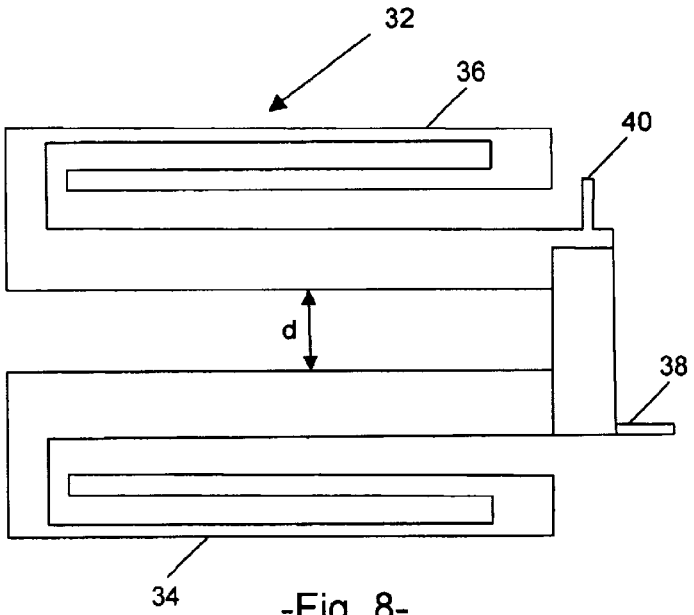
-Fig. 8-
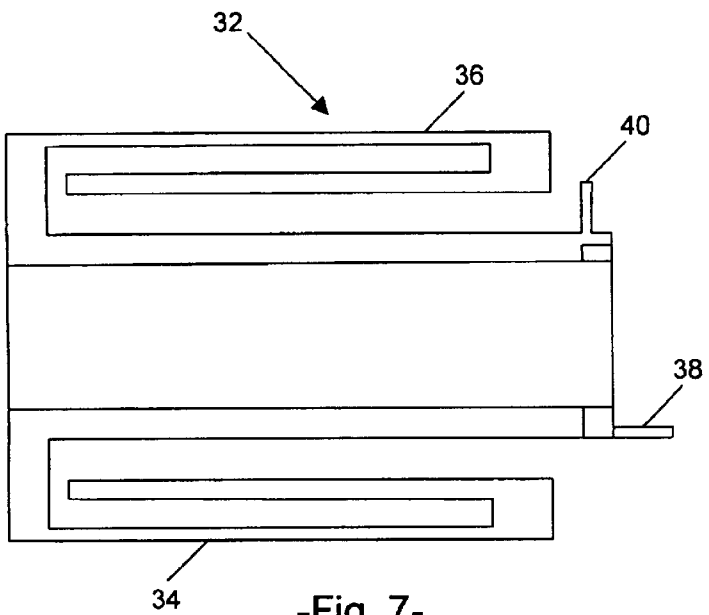
-Fig. 7-
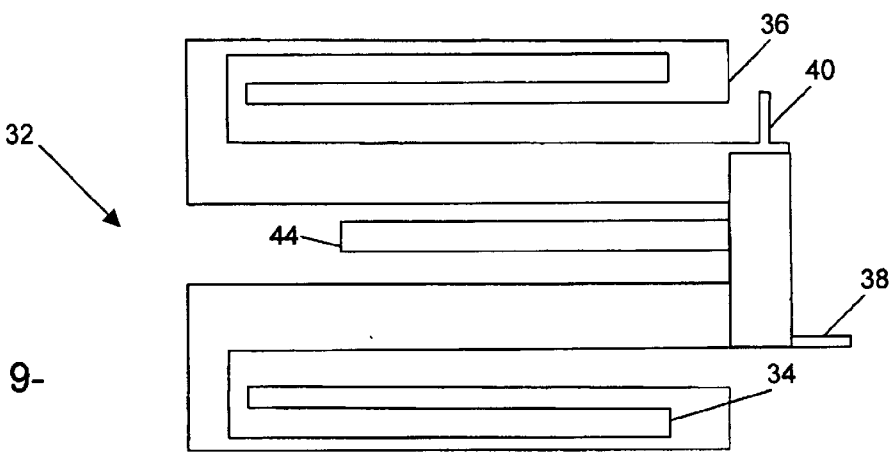
-Fig. 9-

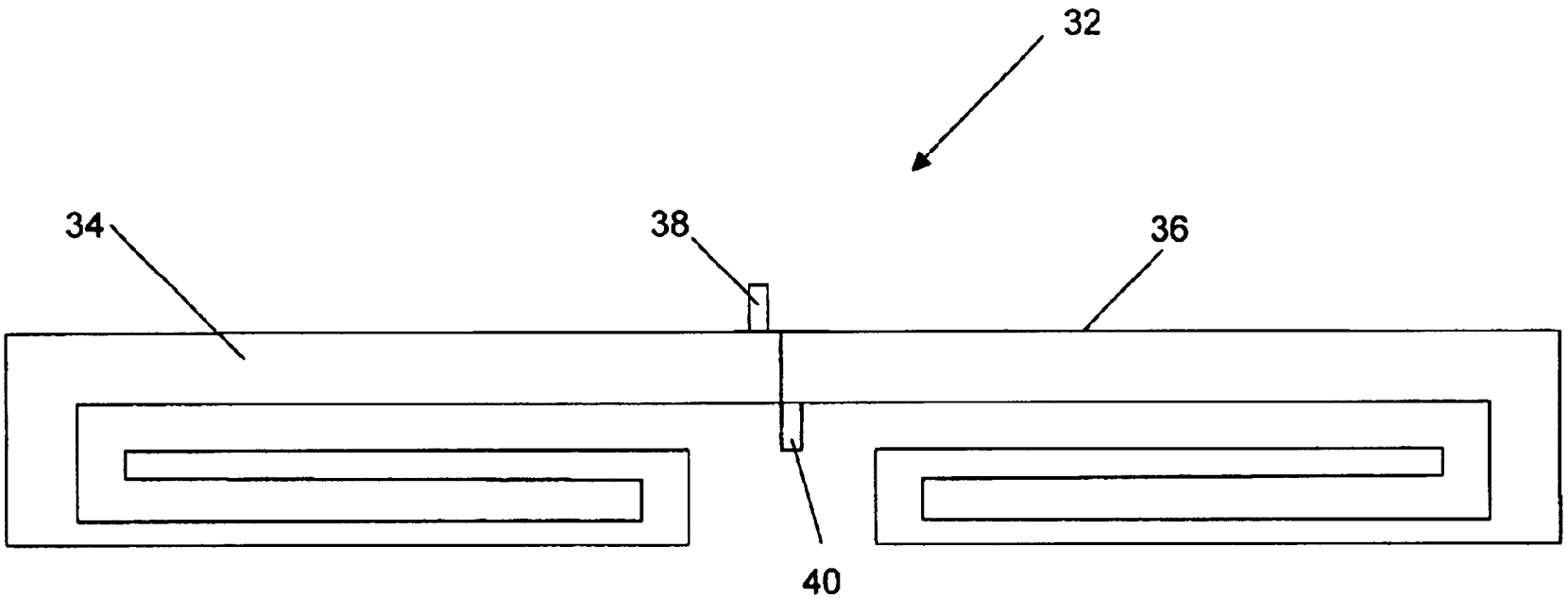
-Fig. 10-

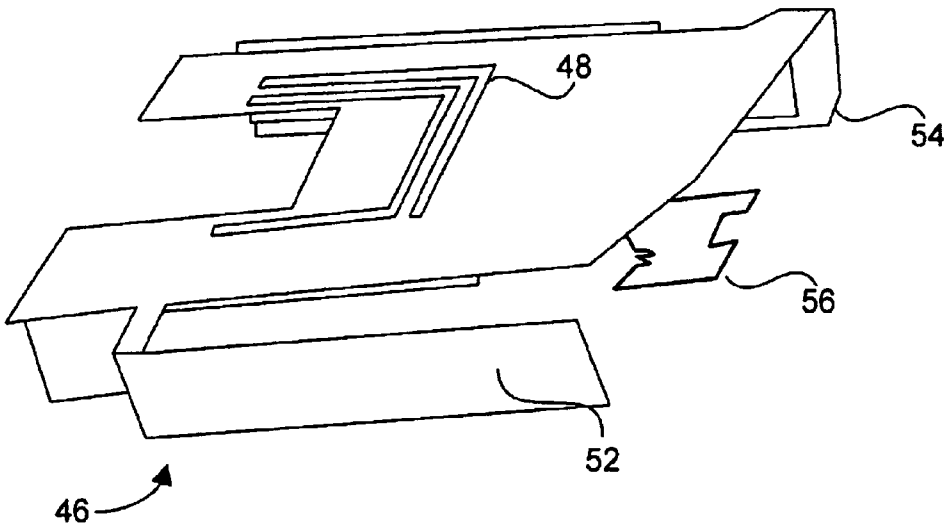
-Fig. 11b-
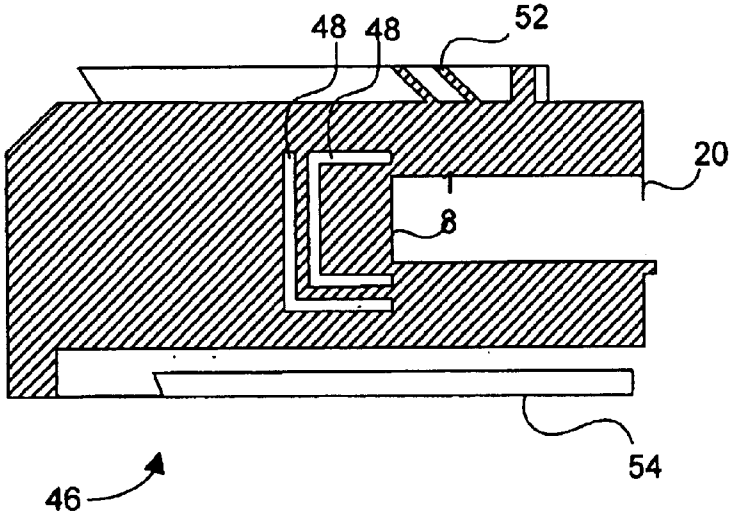
-Fig. 11a-

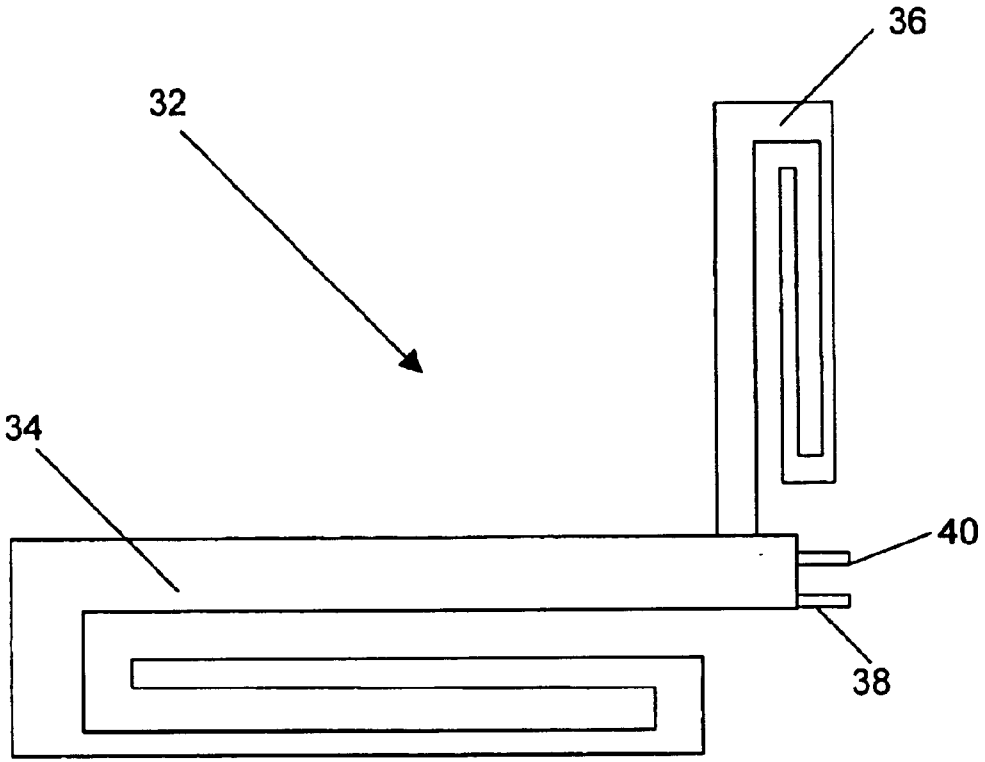
-Fig. 12-

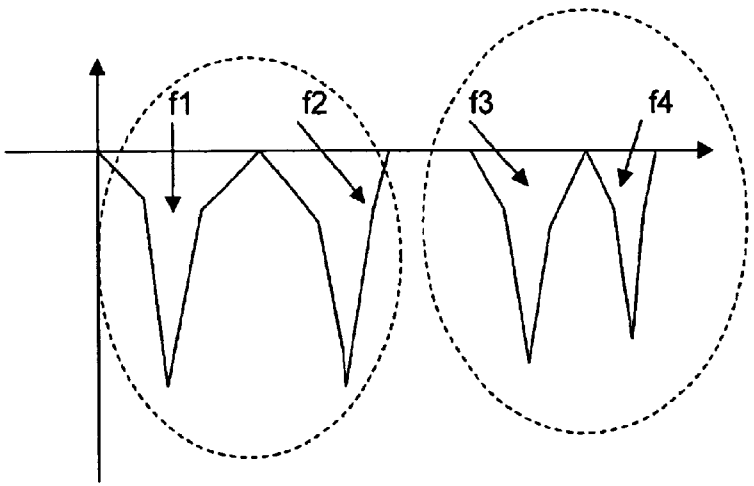
-Fig. 13b-
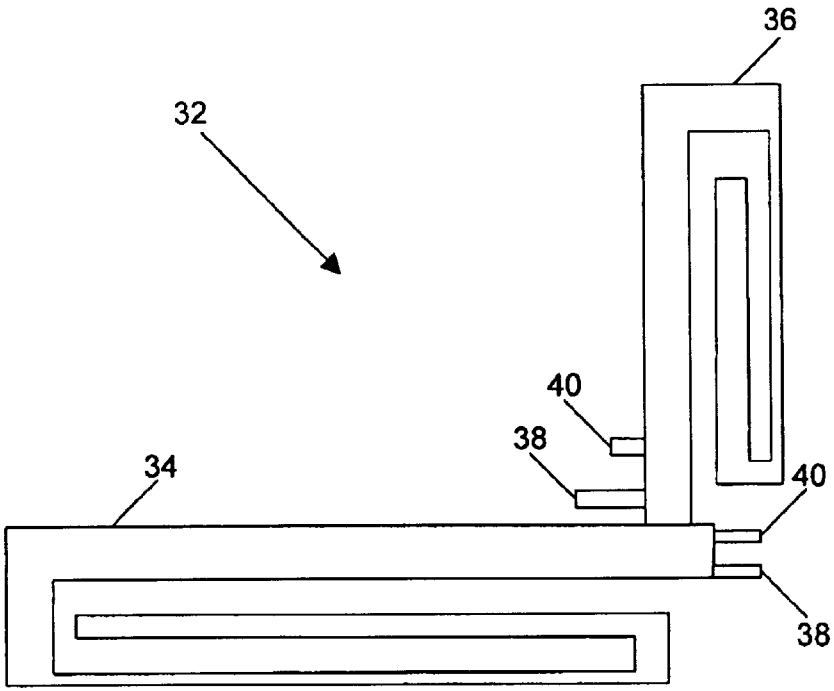
-Fig. 13a-

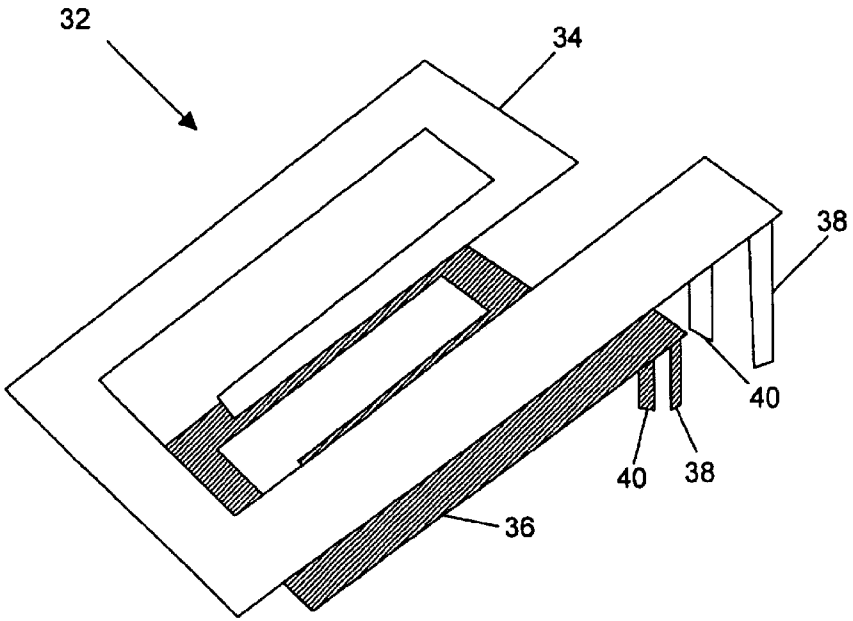
-Fig. 14-
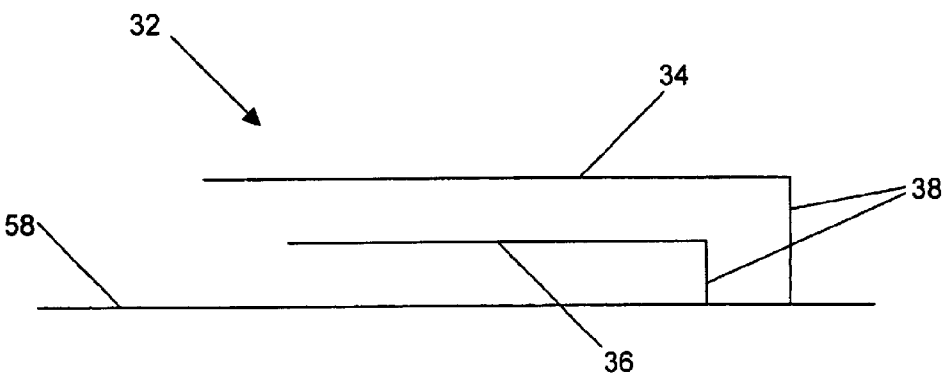
-Fig. 15-

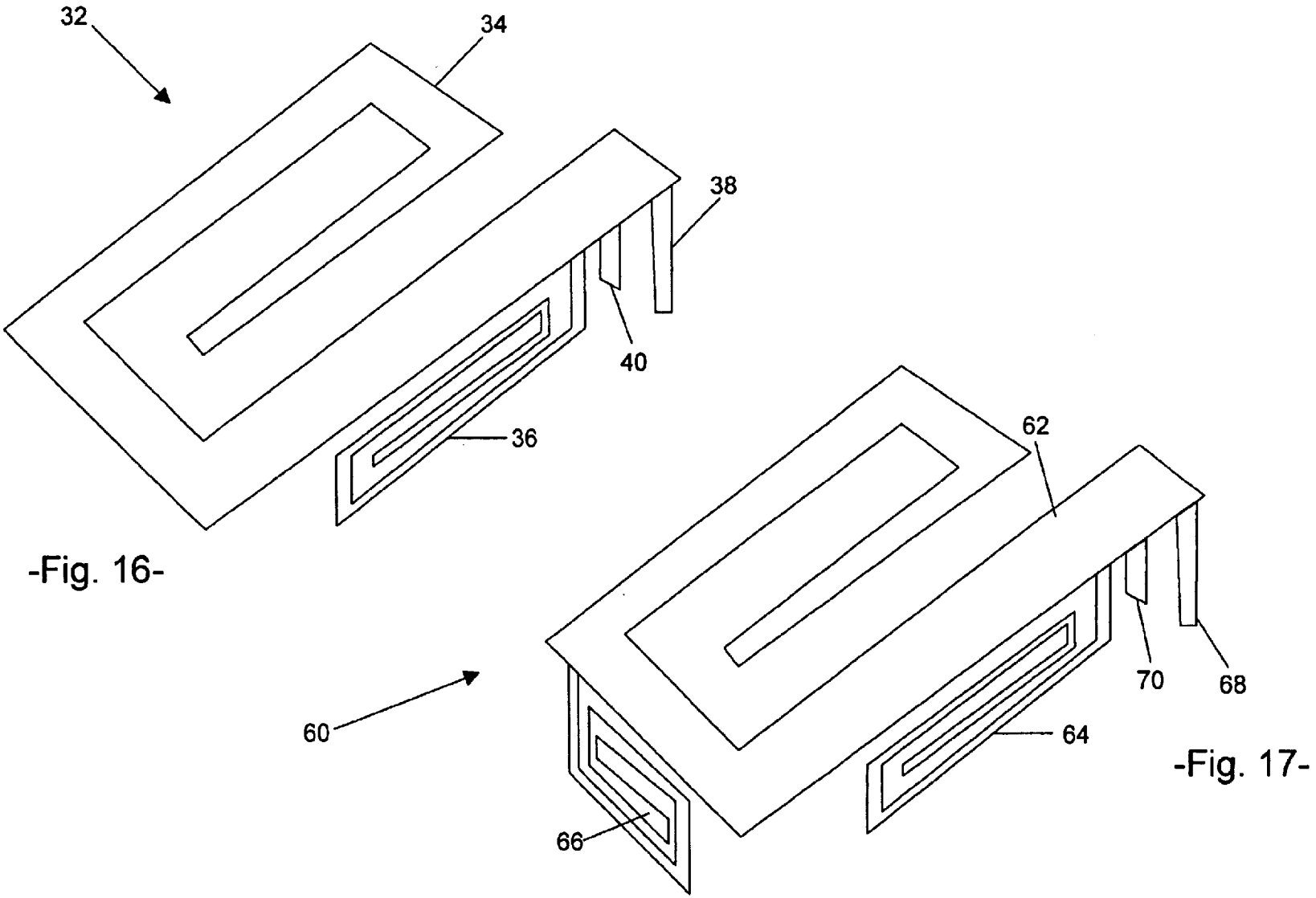
-Fig. 16-
-Fig. 17-

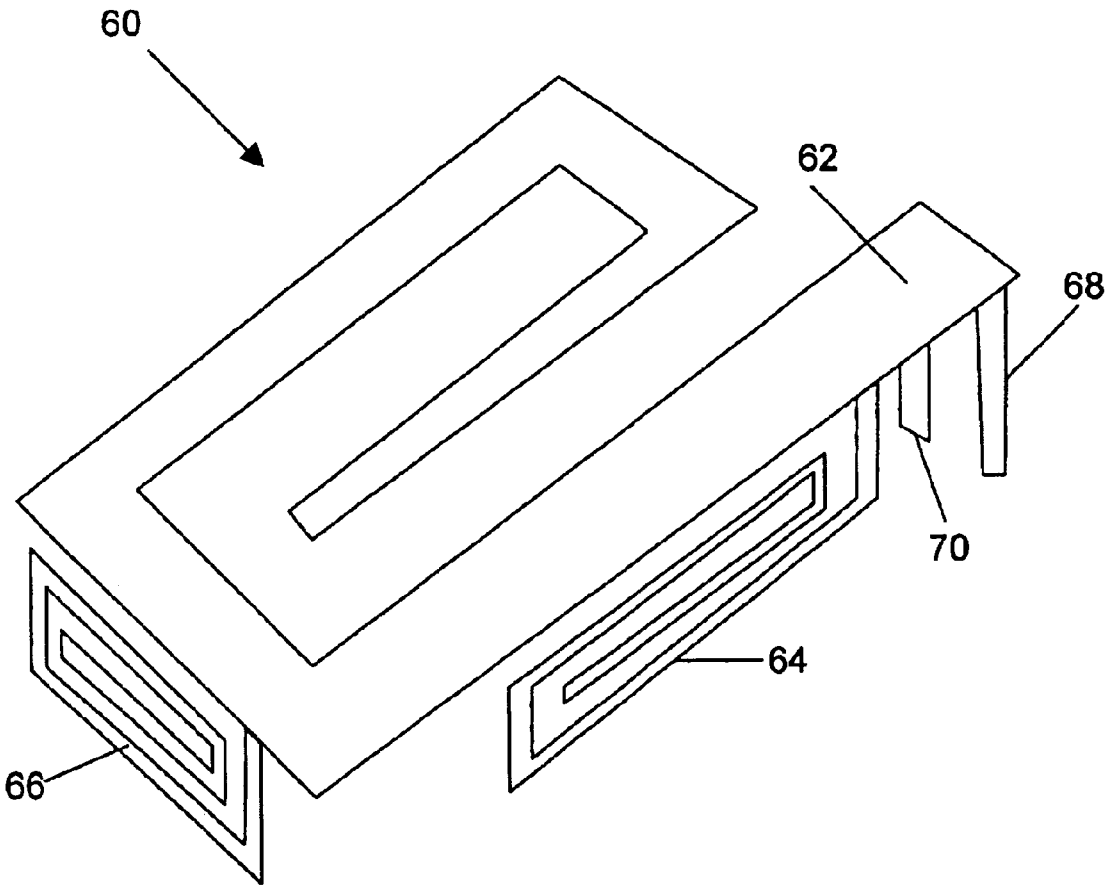
-Fig. 18-

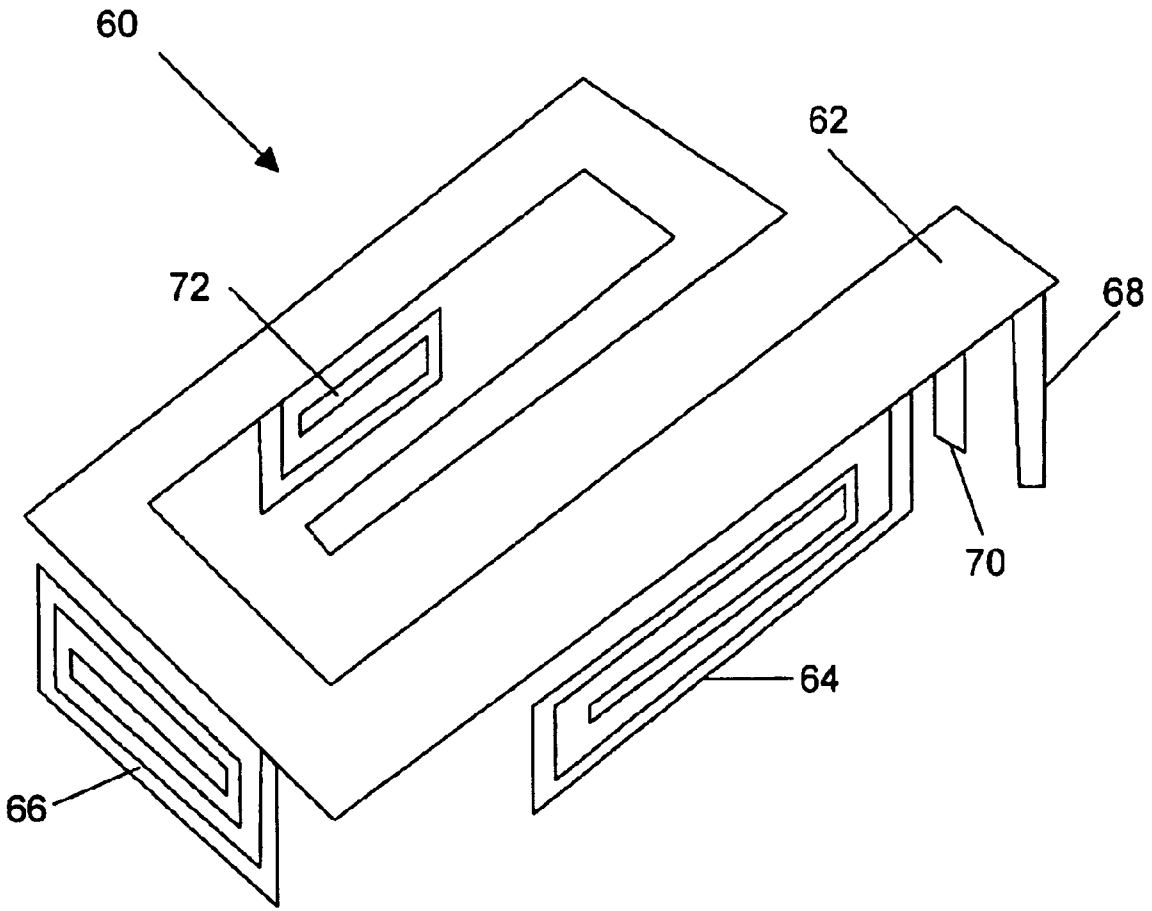
-Fig. 19-

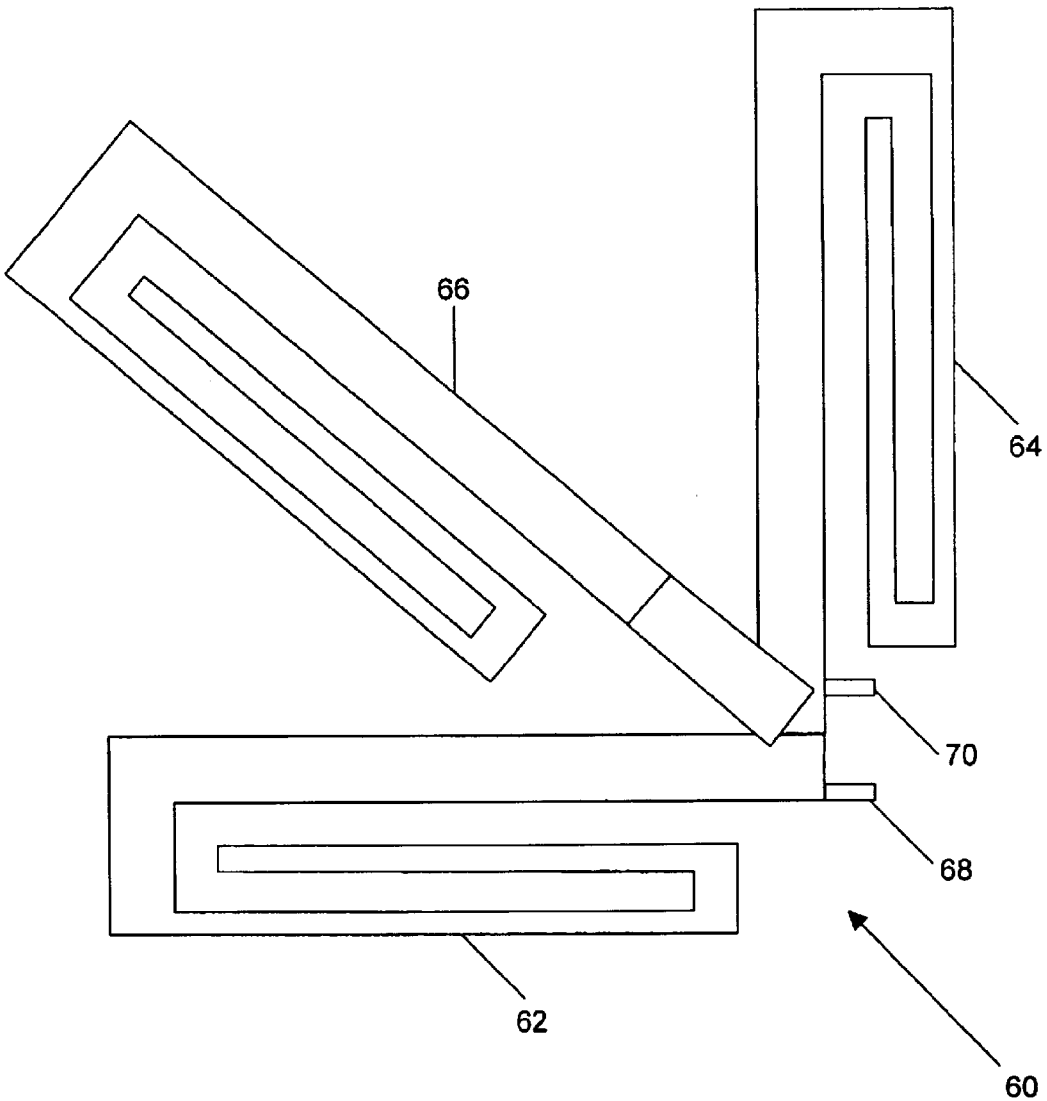
-Fig. 20-

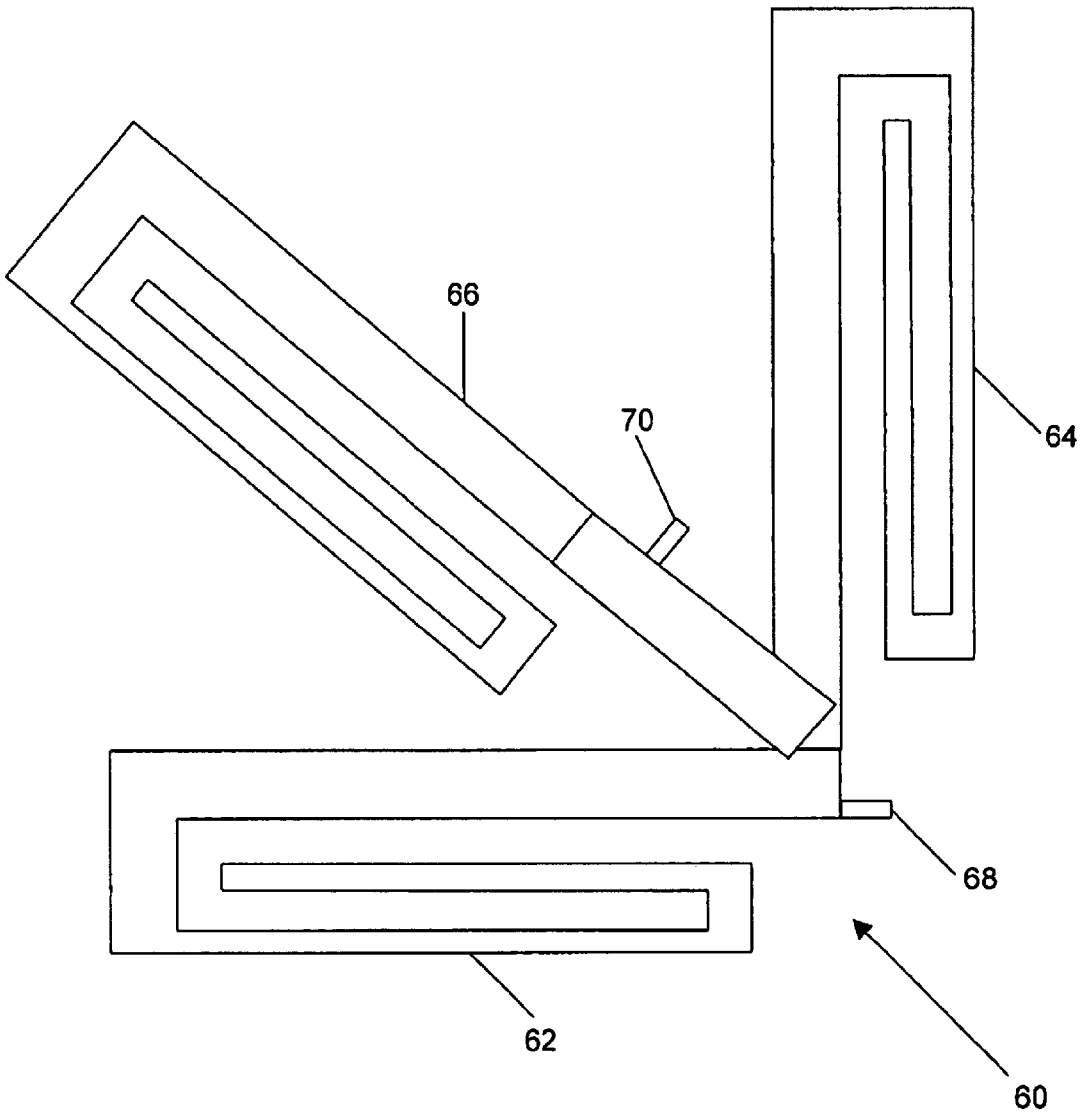
-Fig. 21-

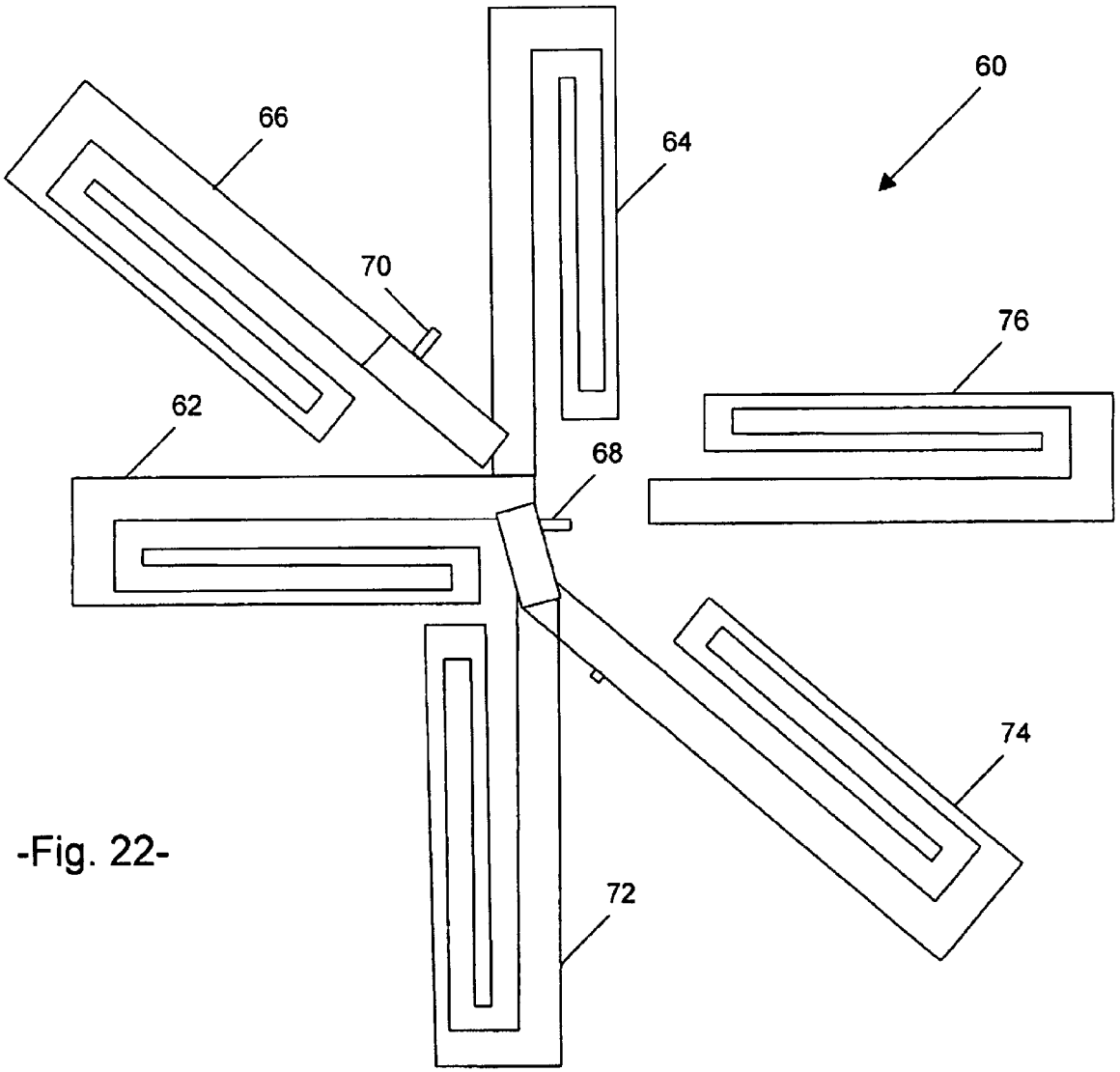
-Fig. 22-

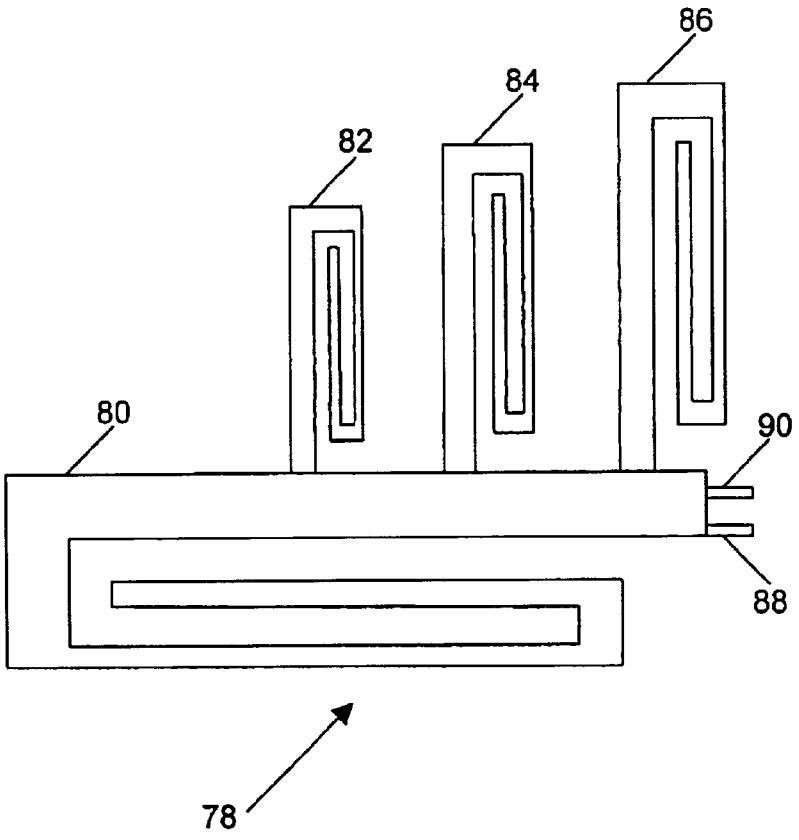
-Fig. 24-
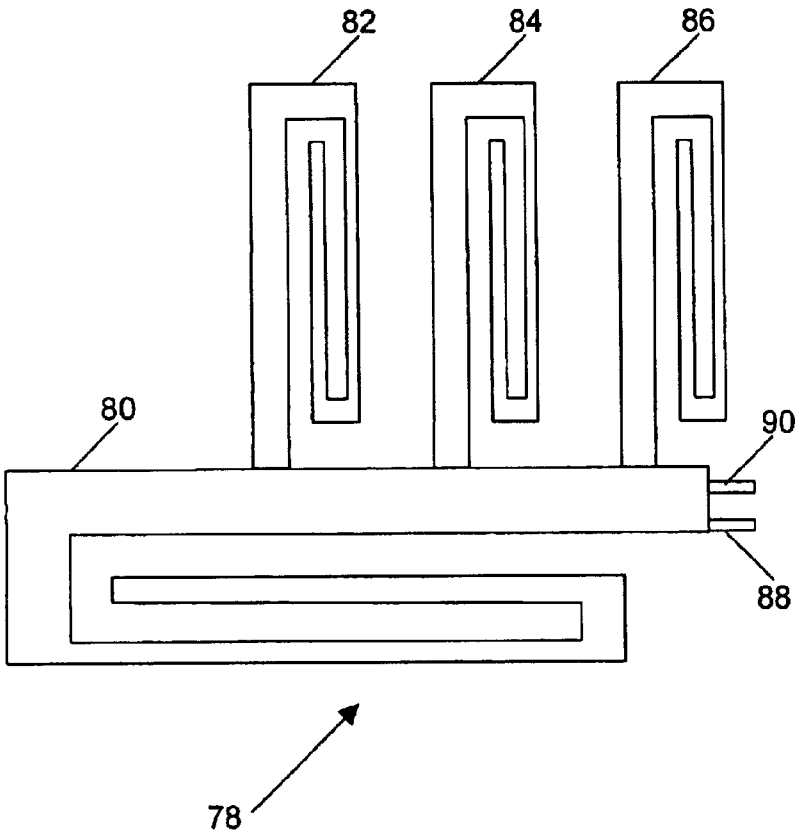
-Fig. 23-

LOW-PROFILE, MULTI-FREQUENCY, MULTI-BAND, MAGNETIC DIPOLE ANTENNA

CROSS-REFERENCE TO RELATED APPLICATIONS

This application relates to co-pending application Ser. No. 09/892,928, filed on Jun. 26, 2001, now U.S. Pat. No. 6,456,243, entitled "Multi Frequency Magnetic Dipole Antenna Structure and Methods Reusing the Volume of an Antenna" by L. Desclos et at., owned by the assignee of this application and incorporated herein by reference.

This application relates to co-pending application Ser. No. 10/076,922, now pending entitled "Multi Frequency Magnetic Dipole Antenna Structures with a New E-Field Distribution for Very Low-Profile Antenna Applications" by G. Poilasne et al., owned by the assignee of this application and incorporated herein by reference.

BACKGROUND INFORMATION

1. Field of the Invention

The present invention relates generally to the field of wireless communications, and particularly to multi-band antennas used in wireless communications.

2. Background

Certain applications such as the Global System for Mobile Communications (GSM) and Personal Communications Service (PCS) require that multiple bands be accessible, depending upon the local frequency coverage available from a service provider. Because applications such as GSM and PCS are used in the context of wireless communications devices that have relatively small form-factors, a low profile is also required.

A magnetic dipole antenna (MDA) is a loop antenna that radiates electromagnetic waves in response to current circulating through the loop. The antenna element of an MDA is designed so that it resonates at the frequency required by the ultimate application for which the antenna is intended. The antenna's resonant frequency is dependent on the capacitive and inductive properties of the antenna elements, which in turn are controlled by various dimensions of the antenna elements.

For some applications, it is desirable to expand the frequency range of an antenna to cover a wider band of frequencies. However, size constraints often make it difficult to design an antenna with a frequency band wide enough to meet these applications needs. The present invention addresses the requirements of certain wireless communications applications by providing configurations for tow profile, multi-frequency, multi-band, magnetic dipole antennas.

SUMMARY OF THE INVENTION

The present invention discloses a myriad of physical arrangements of antenna elements configured to cover one to n number of frequencies or bands of frequencies. In the present invention, the antenna elements include both inductive and capacitive parts. Each element provides frequencies or bands of frequencies. The physical design of each element can vary, but always allows for multi-frequencies by using a plurality of antenna elements to produce a multi-frequency antenna. Furthermore, the arrangement of a plurality of antenna elements allows the frequency coverage of the antenna to be enlarged.

Each antenna element is cut, folded, and/or arranged to meet both the frequency and space requirements of the specific application. In one embodiment, each antenna element comprises three arms arranged to produce multiple frequency bands. Multiple elements of relatively the same size can be arranged in various fashions such that the frequency bands produced by each element combine to enlarge each frequency band produced by each element. Alternatively, the multiple elements can be of varying sizes to increase the number of frequency bands produced by the antenna.

The ground and feed points of the antenna can be arranged in various fashions to meet the needs of a specific antenna application. In addition, filters can be added to or incorporated into the antenna elements in a variety of ways for frequency matching or to reject unused frequency bands. For example, in one embodiment the filter is formed by attaching a matching element, which can be a piece of conductive material, to the antenna element. In another embodiment, the filter can be formed by removing material from the antenna element.

Further features and advantages of this invention as well as the structure and operation of various embodiments are described in detail below with reference to the accompanying drawings. This summary does not purport to define the invention.

BRIEF DESCRIPTION OF THE DRAWINGS

FIG. 1*a* is a top view of one embodiment of an antenna element according to the present invention;

FIG. 1*b* is a graphical representation of the frequencies produced by the antenna element of FIG. 1*a;*

FIG. 2*a* is a top view of an alternative embodiment of the antenna element of FIG. 1*a* including an inductive bridge between two arms of the element;

FIG. 2*b* is a top view of an alternative embodiment of the antenna element of FIG. 1*a* having slots inserted into one arm of the element;

FIG. 2*c* is a top view of another alternative embodiment of the antenna elements of FIG. 1*a* including an inductive bridge between two arms of the element;

FIG. 2*d* is a top view of another alternative embodiment of the antenna elements of FIG. 1 a including multiple inductive bridges between two arms of the element;

FIG. 2*e* is a graphical representation of one frequency band produced by the antenna element of FIG. 2*d;*

FIG. 2*f* is a top view of another alternative embodiment of the antenna elements of FIG. 1*a*showing an alternative feeding structure;

FIG. 2*g* is a side view of the antenna element of FIG. 2*f;*

FIG. 3*a* is a perspective view of an alternative embodiment of the antenna of FIG. 3 including an external matching arm;

FIG. 3*b* is a perspective view of an alternative embodiment of the antenna of FIG. 3*a;*

FIG. 3*c* is a top view of an alternative embodiment of the antenna element of FIG. 1*a;*

FIG. 3*d* is a top view of an alternative embodiment of the antenna element of FIG. 3*c;*

FIG. 3*e* is a top view of an alternative embodiment of the antenna element of FIG. 3*c;*

FIG. 3*f* is a top view of an alternative embodiment of the antenna element of FIG. 3*c;*

FIG. 4 is a top view of an antenna having multiple antenna elements according to the present invention;

FIG. 5 is a top view of an alternative embodiment of the antenna of FIG. 4 with a modified feeding structure;

FIG. 6 is a top view of an alternative embodiment of the antenna of FIG. 5;

FIG. 7 is a top view of an alternative embodiment of the antenna of FIG. 5;

FIG. 8 is a top view of an alternative embodiment of the antenna of FIG. 7;

FIG. 9 is a top view of an alternative embodiment of the antenna of FIG. 7;

FIG. 10 is a top view of an alternative embodiment of the antenna of FIG. 5;

FIG. 11*a* is a top view of an alternative embodiment of an antenna according to the present invention including matching elements and filters;

FIG. 11*b* is a perspective view of the antenna of FIG. 25.

FIG. 12 is a top view of an alternative embodiment of the antenna of FIG. 4;

FIG. 13*a* is a top view of an alternative embodiment of the antenna of FIG. 12 with a modified feeding structure;

FIG. 13*b* is a graphical representation of the frequencies produced by the antenna of FIG. 13*a;*

FIG. 14 is a perspective view of an alternative embodiment of an antenna according to the present invention;

FIG. 15 is a side view of the antenna of FIG. 14;

FIG. 16 is a perspective view of an alternative embodiment of an antenna according to the present invention;

FIG. 17 is a perspective view of an alternative embodiment of the antenna of FIG. 16 including an additional antenna element;

FIG. 18 is a perspective view of an alternative embodiment of the antenna of FIG. 17;

FIG. 19. is a perspective view of an alternative embodiment of the antenna of FIG. 18 including an additional antenna element;

FIG. 20 is a top view of an alternative embodiment of the antenna of FIG. 5 including an additional antenna element;

FIG. 21. is a top view of an alternative embodiment of the antenna of FIG. 20 with modified feeding structure;

FIG. 22,is a top view of an alternative embodiment of the antenna of FIG. 20 with additional antenna elements;

FIG. 23 is a top view of an alternative embodiment of the antenna of FIG. 12 with additional antenna elements;

FIG. 24 is a top view of an alternative embodiment of the antenna of FIG. 23 with antenna elements of varying size.

DETAILED DESCRIPTION OF THE INVENTION

In the following description, for purposes of explanation and not limitation, specific details are set forth in order to provide a thorough understanding of the present invention. However, it will be apparent to one skilled in the art that the present invention may be practiced in other embodiments that depart from these specific details. In other instances, detailed descriptions of well-known methods and devices are omitted so as to not obscure the description of the present invention with unnecessary detail.

Referring now to the drawings, an antenna element which can be used according to the present invention is generally designed by reference numeral 10 in FIG. 1*a*. The antenna element 10 comprises three antenna arms 12, 14, and 16. The antenna element 10 is fed through the feeding structure comprising feed line 18 and ground line 20. The antenna arms 12, 14, and 16 are configured to produce circulating current flows which cause the antenna element 10 to radiate at a low frequency (f1) and a high frequency (f2).

Arms 12 and 14 form a large u-shaped antenna element which is fed by feed line 18. This structure produces a current flow indicated by line 22 causing the antenna element 10 to radiate at low frequency (f1). Arms 14 and 16 form a small u-shaped antenna element which is fed through electromagnetic coupling with arm 12, which is represented by dashed line 24. This small structure produces a current flow which causes the antenna element 10 to radiate at high frequency (f2). This antenna element design creates inductive and capacitive elements which create the antenna frequency bands. For example, arms 12 and 16 form a first capacitive part of antenna 10 and arms 14 and 16 form a second capacitive part. Corresponding inductive parts of the antenna 10 are created between the arms 12, 14 and 16 and a ground plate (not shown except in FIG. 15).

Antenna element 10 can be modified for different applications. For example, FIGS. 2*a*, 2*b* and 2*c*, illustrate various ways to modify the inductance of antenna element 10. FIG. 2*a* shows adding an inductive bridge 26 between arms 12 and 16. The inductive bridge 26 can be used to widen the tow frequency band (f1) of antenna element 10. The inductive bridge 26 can also be used to widen the high frequency band (f2) of antenna element 10 by adjusting its placement and width. The effect the inductive bridge 26 has on antenna performance can be controlled to suit many different antenna applications. For example, some of the factors which determine the effect the inductive bridge 26 has on antenna 10 are the width of element 12, the width of the inductive bridge 26, the position of the inductive bridge 26 along the length of element 12, and the width of the gap between elements 12 and 16.

FIG. 2*c*shows adding an inductive bridge 30 between arms 14 and 16. This inductive bridge 30 can be used to widen the high frequency band (f2) of antenna element 10. Similar to inductive bridge 26, inductive bridge 30 can be used to widen the low frequency band (f1) of antenna element 10 by adjusting its placement and width.

FIG. 2*d* show adding multiple inductive bridges 31 between arms 12 and 16. The additional inductive bridges 31 can be used to further widen the low (or high) frequency band of antenna element 10. For example, the embodiment shown in FIG. 2*d* can be configured to produce an expanded low frequency band (f1) like the one shown in FIG. 2*e*.

FIG. 2*b*shows inserting slots 28 into arm 12. Slots 28 allow the length of element 12 to be shortened without effecting antenna performance. FIG. 2*c*shows placing an inductive bridge 30 between arms 14 and 16 to widen the bandwidth at the high frequency (f2), similar to the way inductive bridge 26 operates. Various other modifications can be made to antenna element 10 and various other antenna element configurations can be used for the purposes of the present invention. For example, various other suitable antenna element configurations are set forth in co-pending application Ser. No. 10/133,717 entitled "Low-profile, Multi-Frequency, Multi-Band, Capacitively Loaded Magnetic Dipole Antenna" which is incorporated herein by reference.

FIGS. 2*f*–2*g* show an alternative feeding structure arrangement in which the feed line 18 cut away from arm 12. As shown, the feed line 18 formed from a piece of arm 12 which is cut away and folded down. The ground line 20 is attached to the end of arm 12.

As shown in FIGS. 3*a* and 3*b*, a matching element 21 can be added to the antenna element 10 enabling additional control over the antenna element environment through frequency matching. Matching element 21 capacitively couples with arm 12 of the antenna element 10. In FIG. 3*a*, matching element 21 is connected to arm 12. In FIG. 3*b*, matching element 21 is connected to feed line 18. Whether the matching element 21 is attached to arm 12 of feed line 18 can be dictated by size considerations of the antenna application. The matching element 21 can be configured to widen the frequency bands produced by antenna element 10. Some of the factors which dictate the effect the matching element 21 has on the antenna element 10 include the length of the matching element 21 and the gap between matching element 21 and the antenna element arm 12. For example, the longer the length of the matching element 21, the more it affects the low frequency (f1) component. Conversely, the shorter the length the more it affects the high frequency (f2) component. With respect to the gap, generally the smaller the gap between the matching element 21 and arm 12, the more the high frequency (f2) component is affected and the larger the gap, the more the low frequency (f1) component is affected.

FIGS. 3*c*–3*f* show alternative embodiments of matching element 21. FIG. 3*c* shows matching element 21 extending vertically downward from the outside edge of arm 12. FIG. 3*d* shows matching element 21 attached to the outside edge of arm 12 and extending perpendicular under arm 12 to under arm 16 where it extends parallel under arm 16. FIG. 3*e* shows matching element 21 attached to the outside edge of arm 12 and extending perpendicular under arm 12 to under arm 14 where it extends parallel under arm 14. FIG. 3*f* shows matching element 21 attached to the outside edge of arm 12 and extending under arm 12 at one diagonal to under arm 16 where it extends at another diagonal to under arm 14.

The antenna 32 shown in FIG. 4 comprises two antenna elements 34 and 36 fed through a signal feeding structure using feed line 38 and ground line 40. In the embodiment shown in FIG. 4, antenna elements 34 and 36 are arranged perpendicular to each other and are connected at their open ends. Both feed line 38 and ground line 40 are attached to element 34 but are configured to power both element 34 and element 36. This 90 degree arrangement between elements 34 and 36 minimizes coupling between the elements and thus maximizes the bandwidth of antenna 32.

As described above, antenna elements 34 and 36 are each configured to radiate a high frequency and a low frequency, thus producing four separate frequency bands (f1, f2, f3, and f4). The structure of the antenna elements 34 and 36 and their arrangement with respect to each other can be designed such that the low frequencies (f1 and f3) of both elements are near enough on the frequency spectrum to partially combine to form a single, enlarged low frequency band. Similarly, the antenna 32 can be designed such that the high frequencies (f2 and f4) of both elements 34 and 36 are also near enough on the frequency spectrum to partially combine to form a single, enlarged high frequency band. Generally, in order for the antenna elements 34 and 36 to produce frequency bands that combine, antenna elements 34 and 36 should be similarly sized. However, even if elements 34 and 36 are not similarly sized, they can be configured to produce overlapping frequency bands by adjusting the arm lengths and gaps between the arms. Alternatively, the antenna 32 can be configured so that the four frequency bands (f1, f2, f3, and f4) do not overlap allowing them to be used as in a communication system with two separate transmit and receive frequencies. Conversely to the situation described about, generally elements 34 and 36 should be different sized elements in order to produce frequency bands that do not overlap. However, even if elements 34 and 36 are similarly sized, they can be designed to produce non-overlapping frequency bands such as by adjusting the arm lengths and gaps between the arms.

FIG. 5 illustrates an alternative feeding structure for the antenna of FIG. 4. In FIG. 5, ground line 40 is connected to element 36 while feed line 38 is connected to element 34. This feeding structure can be used to power both elements 34 and 36. This and other alternative feed structure arrangements can be made to accommodate size constraints imposed by various antenna applications.

FIG. 6 illustrates an alternative embodiment of the antenna shown in FIG. 5. In FIG. 6, elements 34 and 36 are arranged at an angle 42 less than 90 degrees. This allows the overall structure of the antenna 32 to be more compact allowing it to be used for applications in which space of limited. However, because the elements 34 and 36 are no Longer perpendicular, coupling occurs between the elements which can reduce the bandwidth of antenna 32. This coupling can be compensated for in a variety of ways such as, among other ways, adjusting the arm lengths of each element 34, 36 and/or adjusting the gaps between the arms.

FIGS. 7–9 illustrate various embodiments in which elements 34 and 36 are arranged parallel to each other. In these embodiments, feed line 38 is connected to element 34 and ground line 40 is connected to element 36, however the feed line 38 and ground line 40 could be reversed or both be attached to either element 34 or 36. In this configuration, the coupling between the elements 34, 36 is very high since the magnetic fields created by each element are parallel to each other. In the embodiment shown in FIG. 7 the elements 34 and 36 are connected. In FIG. 8, the elements 34 and 36 are separated by a distance (d) which can be used to match the elements 34 and 36 return loss and efficiency. The coupling created between elements 34 and 36 decreases as the distance (d) between the elements increases. Conversely, the coupling is increased as the distance (d) decreases. Indirectly, the return loss of the elements 34 and 36 is proportional to the magnetic coupling between the elements 34 and 36. In FIG. 9, a matching element 44 is added between elements 34 and 36. Matching element 44 can be used for frequency matching for all frequency bands produced by antenna 32. Thus, matching element 44 can be used to increase the bandwidth of antenna 32. Also, as with the previously described embodiments, the Length of the antenna element arms and the gaps between the arms can be adjusted to compensate for coupling and to increase the bandwidth of antenna 32.

FIG. 10 illustrates an alternative embodiment of FIG. 5 in which the angle between elements 34 and 36 is 180 degrees. In this embodiment, the feed line 38 is moved to the side (rather than the end) of element 34 in order to accommodate the connection between elements 34 and 36. In this embodiment, there is only minimal coupling at the ends of the elements 34 and 36 but little or no magnetic coupling that would affect the bandwidth of antenna 32. This arrangement can be used in antenna applications in which the a long, narrow piece of real estate is available for the antenna.

FIGS. 11*a* and *b* illustrate one embodiment of the invention that includes various filters and matching elements to customize and optimize operation of the antenna 46 for a particular application. This embodiment shows various filters 48 cut into antenna element 46. Filters of this type, which allow element 46 to produce multiple frequency bands, are described in more detail in the co-pending applications mentioned above which have been incorporated by reference. Antenna 46 also includes a second antenna element 52 and a matching element 54 attached to the sides of antenna element 46. An additional parasitic element 56 can also be included inside antenna 46. Parasitic element 56 is feed through magnetic coupling and is configured to general additional frequency bands. As with the other antenna elements described herein, parasitic element 56 can be configured to produce overlapping frequency bands which combine with the frequency bands produced by the other antenna elements 46, 52 or can be configured to produce non-overlapping frequency bands. Feed line 18 and ground line 20 are shown attached to element 46.

As shown in FIG. 12, antenna elements 34 and 36 can also be different sizes. The size of an antenna element 34, 36 largely dictates its resonant frequency band, i.e. the smaller the antenna element the higher the resonant frequency band. Thus, by making element 36 smaller than element 34, the embodiment of antenna 32 shown in FIG. 12 is configured to produce four separate frequency bands, which could be configured as the send and receive bands for two distinct systems such as 800 MHz and 1900 MHz. Alternatively, the different sized antenna elements 34 and 36 shown in FIG. 12 could be designed to produce overlapping frequency bands by adjusting various attributes of the antenna elements such as, among other things, the length of the antenna elements arms and/or the gaps between the arms. In this embodiment, the feed line 38 and ground line 40 are both connected to element 36.

Alternatively, as shown in FIG. 13*a*, each antenna element 34 and 36 can be configured with its own feed line 38 and ground line 40. Designing antenna 32 with separate feeding structures for element 34 and 36 may be desirable in situation in which the device that incorporates antenna 32 has more than one module. For example, the device may have separate Bluetooth™ and GSM modules. In this case, it may be desirable to separate each antenna element's feeding structure to take advantage of these separate modules. FIG. 13*b* illustrates the frequencies (f1, f2, f3 and f4) which could be produced by the embodiment of antenna 32 shown in FIG. 13*a* . As is shown, antenna element 34 could be configured to produce the lower frequency send and receive bands (f1, f2), in the 800 MHz range and antenna element 36 could be configured to produce the higher frequency send and receive bands (f3, f4) in the 1900 MHz range.

FIGS. 14 and 15 illustrate an embodiment of antenna 32 in which elements 34 and 36 are stacked in a vertical manner. Size constraints of an antenna application may require that the separate antenna elements 34 and 36 be stacked in this vertical manner. While there is come magnetic coupling between elements 34 and 36 in this arrangement, the coupling can be controlled and minimized by, among other ways, adjusting the gap between the elements 34, 36 and their alignment with respect to each other. In this embodiment, both elements 34 and 36 have their own feed line 38 and ground line 40. However, the antenna 32 could be designed with one feeding structure by making one of the elements 34 or 36 parasitic as described herein with respect to other embodiment of the invention. In FIG. 15, the elements 34 and 36 are shown attached to a ground plane 58. Similar to the embodiment illustrated in FIG. 13*a*, elements 34 and 36 are different sizes and thus can be configured to produce multiple frequency bands across the spectrum. It should be noted that one advantage to the various antenna arrangements discussed herein is that antenna 32 can be designed to fit within the space constraints of various applications.

FIG. 16 illustrates still another embodiment of antenna 32. In this embodiment, antenna element 36 is attached to the side of element 34 facing the same direction but at a 90 degree angle with element 34. This arrangement minimizes coupling between elements 34 and 36 similar to the embodiment illustrated in FIGS. 4 and 5. Element 36 can be attached to any arm of element 34, facing any direction, in order to accommodate size constraints placed on the antenna 32 by particular antenna applications. Similar to the embodiment illustrated in FIG. 12, element 36 is smaller than element 34. Feed line 38 and ground line 40 are attached to element 34.

FIG. 17 illustrates an alternative embodiment of the antenna of FIG. 16. The antenna 60 shown in FIG. 17 includes three antenna elements 62, 64 and 66. Antenna elements 64 and 66 are attached to the sides of element 62 at a 90 degree angle with element 62. Elements 62, 64 and 66 are all different sizes. Thus, each antenna element 62, 64, and 66 can be configured to produce two frequency bands at different places on the frequency spectrum. Similar to how the antenna embodiments shown in FIGS. 12–16 can be configured to operate with two separate communication systems at different frequency bands, the antenna 60 can be configured to operate with three separate communications each at a different frequency band. FIG. 17 shows element 66 facing in a direction opposite to elements 62 and 64, however element 66 can be arranged in the same direction as elements 62 and 64 as shown in FIG. 18. In embodiments shown in both FIGS. 17 and 18, the feed line 68 and ground line 70 are attached to element 62.

FIG. 19 illustrates an alternative embodiment of the antenna 60 shown in FIG. 18. The antenna 60 shown in FIG. 19 includes still another antenna element 72 attached to element 62. Element 72 is arranged in a semi-circular way with elements 64 and 66 in the direction of current flow in element 62. Alternatively, element 72, or elements 64 or 66, could also be arranged in the opposite direction or any combination thereof to accommodate the size constraints placed on the antenna 60 by the particular antenna application. In this embodiment, elements 62, 64, 66, and 72 are all different sizes and are configured to produce eight separate frequency bands in four distinct sections on the frequency spectrum (each element producing a high and low frequency in its respective section of the spectrum). However, as described herein with respect to other embodiments of the invention, the characteristics of the antenna elements 62, 64, 66, and/or 72 can be designed to allow the different-sized antenna elements to produce overlapping frequency bands. Alternatively, one of more of elements 62, 64, 66, or 72 could be configured to be about the same size as another element thus acting to produce frequencies bands in the same section which combine to expand to the high and low frequency bands produced by the respective elements as described above. In this embodiment, the feed line 68 and ground line 70 are both attached to element 62.

FIG. 20 illustrates an alternative embodiment of the antenna shown in FIG. 5. The antenna 60 shown in FIG. 20 includes three antenna elements 62, 64, and 66 connected together. Elements 62 and 64 are arranged perpendicular to each other and element 66 is arranged between elements 62 and 64 at an angle of less than 90 degrees from element 62. Because element 66 is not perpendicular to elements 62 and 64, come magnetic coupling is likely to occur between elements. However, this coupling can be controlled and minimized, as described herein with respect to other embodiments of the invention, by altering various characteristics of the antenna elements or by adding matching elements. In this embodiment, elements 62, 64, and 66 are approximately the same size and thus could be configured to produce frequency bands that combine to expand the frequency bands produced by a single antenna element. In this embodiment, feed Line 68 is attached to element 62 and ground line 70 is attached to element 64. Alternatively, as shown in FIG. 21, ground line 70 could be attached to element 66. It is contemplated that other feed line/ground line arrangements are possible and within the scope of this invention.

FIG. 22 illustrates an alternative embodiment of the antenna 60 shown in FIG. 21. This embodiment of antenna 60 includes six antenna elements 62, 64, 66, 72, 74, and 76 attached together. While feed line 68 is shown attached to element 62 and ground Line 70 is shown attached to element 66, the feed line 68 and ground line 70 could be attached to other elements. In this embodiment, the antenna elements 62, 64, 66, 72, 74, and 76 are approximately the same size. Thus, as with the embodiment shown in FIGS. 20 and 21, the antenna elements 62, 64, 66, 72, 74, and 76 can be configured to produce frequency bands that combine to expand the overall frequency bands produced by antenna 60. Alternatively, the elements 62, 64, 66, 72, 74, and 76 could be configured to be different sizes thus producing frequency bands in distinct sectors of the frequency spectrum as previously described for other antenna embodiment discussed herein. In addition, a combination of same-sized and different-sized elements could be designed to produce expanded frequencies (caused by same-sized elements) in distinct sectors of the frequency spectrum (caused by different-sized elements). Additional elements can also be added in different planes (as previously discussed) or elements 62, 64, 66, 72, 74, and 76 could be arranged in different planes in order to meet the space requirements of a specific application.

FIG. 23 illustrates an alternative embodiment of the antenna shown in FIG. 12. The antenna 78 shown in FIG. 23 includes one Large antenna element 80 and three, same-sized, smaller antenna elements 82, 84 and 86. Feed line 88 and ground line 90 are attached to element 80. Large element 80 can be configured to produce a high and low frequency band in one sector of the frequency spectrum, while the three, same-sized, smaller antenna elements 82, 84, and 86 produce an expanded high and low frequency band in a higher sector of the frequency spectrum than that of the large element 80. As described above, the frequency bands produced by elements 82, 84 and 86 combine to produce the expanded high and low frequency bands in the higher sector.

FIG. 24 illustrates an alternative embodiment of the antenna 78 shown in FIG. 23. In this embodiment, elements 82, 84, and 86 are different-sized, smaller antenna elements. Thus, each of elements 82, 84 and 86 produce a high and low frequency band in a different sector of the frequency spectrum. In this manner, because each element 80, 82, 84, and 86 produces a high and Low frequency band in a distinct sector of the frequency spectrum, the embodiment of the antenna 78 shown in FIG. 24 can be configured to operate in four different communication systems which operate at different frequencies. As with other embodiment of the invention described herein, coupling between the elements in the antennas shown in FIGS. 22–24 can be controlled and/or minimized in a variety of ways and various aspects of the antenna element's design and arrangement can be altered to fit the needs of particular antenna applications.

It can be readily appreciated that various other combinations of the above described concepts can be used to adapt an antenna to particular applications. These various combinations are considered within the spirit and scope of the invention described herein. The invention should not be considered limited expect as required by the attached claims.

We claim:

1. A multi-frequency band antenna comprising:

a first antenna element including first, second, and third arms, the first and second arms configured to produce a first capacitive part of the antenna and the second and third arms configured to produce a second capacitive part of the antenna to confine an electric field generated by the antenna in a horizontal plane;

a second antenna element including fourth, fifth, and sixth arms, the fourth and fifth arms configured to produce a third capacitive part of the antenna and the fifth and sixth arms configured to produce a fourth capacitive part of the antenna to confine an electric field generated by the antenna in a horizontal plane;

a ground plate arranged adjacent to the first and second antenna elements, the ground plate and first antenna element configured to produce first and second inductive parts of the antenna and the ground plate and second antenna element configured to produce third and fourth inductive parts of the antenna, the inductive parts of the antenna configured to expel a magnetic field generated by the antenna;

the first and second antenna elements each being configured to produce a low frequency band and a high frequency band thus enabling the antenna to communicate on a variety of frequency bands.

2. The antenna of claim 1, wherein the second antenna element is configured to produces an overlapping low frequency band which overlaps and combines with the low frequency band produced by the first antenna element to create an expanded low frequency band.

3. The antenna of claim 2 wherein the first and second antenna elements are similarly-sized.

4. The antenna of claim 2 wherein the first and second antenna elements are different sized and the fourth, fifth, and sixth arms are configured to compensate for the difference in sizing between the first and second antenna elements enabling the second antenna element to produce the overlapping low frequency band.

5. The antenna of claim 1, wherein the second antenna element is configured to produces an overlapping high frequency band which overlaps and combines with the high frequency band produced by the first antenna element to create an expanded high frequency band.

6. The antenna of claim 5, wherein the first and second antenna elements are similarly-sized.

7. The antenna of claim 5 wherein the first and second antenna elements are different sized and the fourth, fifth, and sixth arms are configured to compensate for the difference in sizing between the first and second antenna elements enabling the second antenna element to produce the overlapping high frequency band.

8. The antenna of claim 1 wherein the second antenna element is configured to produces a second low frequency band which does not overlap or combine with the low frequency band produced by the first antenna element enabling the antenna operate in two low frequency bands.

9. The antenna of claim 8 wherein the first and second antenna elements are different sizes.

10. The antenna of claim 8 wherein the first and second antenna elements are similarly-sized and the fourth, fifth, and sixth arms are configured to compensate for the similarity in sizing between the first and second antenna elements enabling the second antenna element to produce the non-overlapping second low frequency band.

11. The antenna of claim 1 wherein the second antenna element is configured to produces a second high frequency band which does not overlap or combine with the high frequency band produced by the first antenna element enabling the antenna to operate in two high frequency bands.

12. The antenna of claim 11 wherein the first and second antenna elements are different sizes.

13. The antenna of claim 11 wherein the first and second antenna elements are similarly-sized and the fourth, fifth, and sixth arms are configured to compensate for the similarity in sizing between the first and second antenna elements enabling the second antenna element to produce the non-overlapping second low frequency band.

14. The antenna of claim 1 wherein the first and second antenna elements are arranged perpendicular to each other to minimize coupling between the elements.

15. The antenna of claim 1 wherein the first and second antenna elements are arranged at an angle of less than 90 degrees from each other.

16. The antenna of claim 1 wherein the first and second antenna elements are arranged at an angle of greater than 90 degrees from each other.

17. The antenna of claim 1 wherein the first and second antenna elements are arranged at an angle of 180 degrees from each other.

18. The antenna of claim 1 wherein the first and second antenna elements are stacked vertically with respect to each other.

19. The antenna of claim 1 further comprising 1 to n additional antenna elements, each antenna element having three arms and being configured to produce a low frequency band and a high frequency band.

20. The antenna of claim 1 further comprising a feeding structure including a feeding line and a ground line.

21. The antenna of claim 1 further comprising an inductive bridge between two arms of either the first or second antenna element for widening either the low frequency band or the high frequency band of the element.

22. The antenna of claim 1 further comprising slots in at least one arm of either the first or second antenna elements for enabling a more compact antenna design.

23. The antenna of claim 1 further comprising a matching element for providing frequency matching for the antenna.

24. The antenna of claim 1 further comprising at least one slot filter cut into either the first antenna element or the second antenna element.

25. A multi-frequency band antenna comprising:

two to n antenna elements, each antenna element including first, second, and third arms, the first and second arms configured to produce a first capacitive part of the antenna and the second and third arms configured to produce a second capacitive part of the antenna to confine an electric field generated by the antenna in a horizontal plane;

a ground plate arranged adjacent to the two to n antenna elements, the ground plate and each one of the two to n antenna elements configured to produce inductive parts of the antenna, the inductive parts of the antenna configured to expel a magnetic field generated by the antenna;

each one of the two to n antenna elements being configured to produce an overlapping low frequency band and an overlapping high frequency band configured to combine with the overlapping low and high frequency bands, respectively, produced by the other antenna elements to produce an expanded low frequency band and an expanded high frequency band.

26. The antenna of claim 25 wherein the two to n antenna elements are similarly sized.

27. The antenna of claim 25 wherein the two to n antenna elements are different sizes and the first, second, and third arms of each of the two to n antenna elements are configured to compensate for the difference in sizing between the antenna elements thus enabling the antenna elements to produce the overlapping low and high frequency bands.

28. The antenna of claim 25 wherein the two to n antenna elements are arranged perpendicular to each other to minimize coupling between the elements.

29. The antenna of claim 25 wherein the two to n antenna elements are arranged at an angle of less than 90 degrees from each other.

30. The antenna of claim 25 wherein the two to n antenna elements are arranged at an angle of greater than 90 degrees from each other.

31. The antenna of claim 25 wherein the two to n antenna elements are stacked vertically with respect to each other.

32. The antenna of claim 25 further comprising a feeding structure including a feeding line and a ground line.

33. The antenna of claim 25 further comprising an inductive bridge between two arms of any of the two to n antenna elements for widening either the low frequency band or the high frequency band of the element.

34. The antenna of claim 25 further comprising at least one slot in at least one arm of any of the two to n antenna elements for enabling a more compact antenna design.

35. The antenna of claim 25 further comprising a matching element for providing frequency matching for the antenna.

36. The antenna of claim 25 further comprising at least one slot filter cut into any of the two to n antenna elements.

37. The antenna of claim 25 further comprising:

one to m additional antenna elements each additional antenna element including first, second, and third arms, the first and second arms configured to produce a first capacitive part of the antenna and the second and third arms configured to produce a second capacitive part of the antenna to confine an electric field generated by the antenna in a horizontal plane;

each one of the one to m additional antenna elements being configured to produce a distinct low frequency band and a distinct high frequency band enabling the antenna to communicate in a plurality of different frequency bands.

38. The antenna of claim 37 wherein the one to m additional elements are different sizes than the two to n antenna elements.

39. The antenna of claim 37 wherein the one to m additional elements are similarly in size to the two to n antenna elements and wherein the first, second, and third arms of each of the one to m antenna elements are configured to compensate for the similarity in sizing between the one to m and two to n antenna elements thus enabling the one to m antenna elements to produce the distinct low and high frequency bands.

40. A multi-frequency band antenna comprising:

two to n antenna elements, each antenna element including first, second, and third arms, the first and second arms configured to produce a first capacitive part of the antenna and the second and third arms configured to produce a second capacitive part of the antenna to confine an electric field generated by the antenna in a horizontal plane;

a ground plate arranged adjacent to the two to n antenna elements, the ground plate and each one of the two to n antenna elements configured to produce inductive parts of the antenna, the inductive parts of the antenna configured to expel a magnetic field generated by the antenna;

each one of the two to n antenna elements being configured to produce a distinct low frequency band and a distinct high frequency band enabling the antenna to communicate in a plurality of frequency bands.

41. The antenna of claim 40 wherein the two to n antenna elements are different sizes.

42. The antenna of claim 40 wherein the two to n antenna elements are similar in size and the first, second, and third arms of each of the two to n antenna elements are configured to compensate for the similarity in sizing between the antenna elements thus enabling the antenna elements to produce the distinct low and high frequency bands.

43. The antenna of claim 40 wherein the two to n antenna elements are arranged perpendicular to each other to minimize coupling between the elements.

44. The antenna of claim 40 wherein the two to n antenna elements are arranged at an angle of less than 90 degrees from each other.

45. The antenna of claim 40 wherein the two to n antenna elements are arranged at an angle of greater than 90 degrees from each other.

46. The antenna of claim 40 wherein the two to n antenna elements are stacked vertically with respect to each other.

47. The antenna of claim 40 further comprising a feeding structure including a feeding line and a ground line.

48. The antenna of claim 40 further comprising an inductive bridge between two arms of any of the two to n antenna elements for widening either the low frequency band or the high frequency band of the element.

49. The antenna of claim 40 further comprising at least one slot in at least one arm of any of the two to n antenna elements for enabling a more compact antenna design.

50. The antenna of claim 40 further comprising a matching element for providing frequency matching for the antenna.

51. The antenna of claim 40 further comprising at least one slot filter cut into any of the two to n antenna elements.

* * * * *